US008800230B2

(12) United States Patent
O'Connor

(10) Patent No.: US 8,800,230 B2
(45) **Date of Patent: *Aug. 12, 2014**

(54) STACKING MASONRY BLOCK SYSTEM WITH TRANSITION BLOCK AND UTILITY GROOVE RUNNING THERETHROUGH

(71) Applicant: Daniel O'Connor, Millbrook, NY (US)

(72) Inventor: Daniel O'Connor, Millbrook, NY (US)

( * ) Notice: Subject to any disclaimer, the term of this patent is extended or adjusted under 35 U.S.C. 154(b) by 0 days.

This patent is subject to a terminal disclaimer.

(21) Appl. No.: 14/073,439

(22) Filed: Nov. 6, 2013

(65) Prior Publication Data

US 2014/0059962 A1 Mar. 6, 2014

Related U.S. Application Data

(60) Division of application No. 12/610,819, filed on Nov. 2, 2009, now abandoned, which is a continuation-in-part of application No. 11/159,049, filed on Jun. 22, 2005, now Pat. No. 7,610,730.

(51) Int. Cl.

| | |
|---|---|
| ***E04B 2/00*** | (2006.01) |
| ***E04B 5/04*** | (2006.01) |
| ***E04B 2/16*** | (2006.01) |
| ***E04C 1/00*** | (2006.01) |
| *E04B 2/02* | (2006.01) |

(52) U.S. Cl.

CPC ..... *E04C 1/00* (2013.01); *E04B 2002/0208* (2013.01); *E04B 2/16* (2013.01); *E04N 2/26* (2013.01)

USPC ..... 52/442; 52/607; 52/592.6; 52/503

(58) Field of Classification Search

USPC ..... 52/566, 568, 570, 571, 597, 274, 293.2, 52/293.3, 604, 592.6, 606, 745.12, 306, 52/307, 308, 503, 561, 442, 438, 592.3, 52/607; 33/518, 526, 527, 613, 645

See application file for complete search history.

(56) References Cited

U.S. PATENT DOCUMENTS

| | | | |
|---|---|---|---|
| 641,067 | A | 1/1900 | Blazo |
| 1,410,588 | A | 3/1922 | Myers |
| 1,848,357 | A | 3/1932 | Kotrbaty |
| 2,019,653 | A | 11/1935 | Buyer |
| 2,073,665 | A | 3/1937 | Welch |
| 2,105,771 | A | 1/1938 | Holdsworth |
| 2,141,397 | A | 12/1938 | Locke |
| 2,239,537 | A | 4/1941 | Owen |
| 2,269,018 | A | 1/1942 | Guignon, Jr. |
| 2,329,585 | A | 9/1943 | Brewer |
| 2,484,062 | A | 10/1949 | Abbott |
| 2,610,503 | A | 9/1952 | Hall |
| 2,749,739 | A | 6/1956 | Zagray |
| 2,792,704 | A | 5/1957 | Kooiman |
| 2,911,818 | A | 11/1959 | Smith |
| 3,055,460 | A | 9/1962 | Maroney |

(Continued)

*Primary Examiner* — Brent W Herring

(74) *Attorney, Agent, or Firm* — Schmeiser, Olsen & Watts LLP

(57) ABSTRACT

A masonry block system that employs blocks with unique surfaces, top, bottom, and transition, and a locking starter rail for placement below the block wall. The surfaces of the block and the shape of the starter rail are configured so as to lock together, providing a wall system. The system can either be mortarless wherein grout-like material is placed within the blocks to provide a monolithic system. A method of making and installing and various parts, such as the starter rail and block are also disclosed.

2 Claims, 21 Drawing Sheets

(56) References Cited

U.S. PATENT DOCUMENTS

| | | | | |
|---|---|---|---|---|
| 3,180,059 | A | 4/1965 | Persak, Jr. | |
| 3,318,059 | A | 5/1967 | Wright | |
| 3,334,455 | A | 8/1967 | Russell | |
| 3,415,026 | A | 12/1968 | Tillisch et al. | |
| 3,534,518 | A | 10/1970 | Zagray | |
| 3,618,279 | A | 11/1971 | Sease | |
| 3,680,277 | A | 8/1972 | Martin | |
| 3,683,578 | A | 8/1972 | Zimmerman | |
| 3,826,052 | A | 7/1974 | Tenorio | |
| 4,004,385 | A * | 1/1977 | Kosuge | 52/259 |
| 4,956,958 | A | 9/1990 | Caroti | |
| 4,986,048 | A | 1/1991 | McMarlin | |
| 5,193,320 | A | 3/1993 | Coccagna | |
| 5,226,276 | A | 7/1993 | Cahill | |
| 5,361,556 | A | 11/1994 | Menchetti | |
| 5,377,469 | A | 1/1995 | Schmid | |
| 5,379,565 | A | 1/1995 | Vienne | |
| 5,457,926 | A | 10/1995 | Jensen | |
| 5,524,394 | A | 6/1996 | Szabo, Sr. et al. | |
| 5,595,033 | A | 1/1997 | Frey | |
| D387,431 | S | 12/1997 | Tremblay | |
| 5,715,635 | A | 2/1998 | Sherwood | |
| 5,881,511 | A | 3/1999 | Keller, Jr. | |
| 5,966,889 | A | 10/1999 | Zinner | |
| 6,000,186 | A | 12/1999 | Fielding et al. | |
| 6,012,254 | A | 1/2000 | Gaston | |
| 6,088,987 | A | 7/2000 | Simmons et al. | |
| 6,138,426 | A | 10/2000 | Mork et al. | |
| 6,223,493 | B1 | 5/2001 | Ruggeri | |
| 6,253,518 | B1 | 7/2001 | Azar | |
| 6,588,168 | B2 | 7/2003 | Walters | |
| 6,606,835 | B1 | 8/2003 | Bilka | |
| 6,665,994 | B1 | 12/2003 | Ruggeri | |
| 6,763,644 | B1 | 7/2004 | Toledo | |
| 6,769,220 | B2 | 8/2004 | Friesner | |
| 6,931,803 | B1 | 8/2005 | Davis et al. | |
| 6,948,282 | B2 | 9/2005 | Bott | |
| 7,007,436 | B1 | 3/2006 | Kelley | |
| 7,127,865 | B2 | 10/2006 | Douglas | |
| 8,061,095 | B2 * | 11/2011 | Bucheger | 52/223.7 |
| 8,201,379 | B2 * | 6/2012 | Bucheger | 52/745.05 |
| 2002/0038532 | A1 | 4/2002 | Huberty | |
| 2004/0118056 | A1 | 6/2004 | Peters et al. | |
| 2004/0237444 | A1 | 12/2004 | Dunavant | |
| 2007/0199273 | A1 | 8/2007 | Wang | |
| 2009/0173027 | A1 | 7/2009 | Bennett | |

* cited by examiner

STACKING MASONRY BLOCK SYSTEM WITH TRANSITION BLOCK AND UTILITY GROOVE RUNNING THERETHROUGH

RELATED APPLICATIONS

This application is a divisional application of U.S. application Ser. No. 12/610,819, filed Nov. 2, 2009, and entitled "Stacking Masonry Block System with Transition Block and Utility Groove Running Therethrough," which is a continuation-in-part of patent application Ser. No. 11/159,049 filed Jun. 22, 2005, entitled, "Stacking Masonry Block System with Locking Starter Device," now U.S. Pat. No. 7,610,730.

FIELD OF INVENTION

This invention relates generally to the field of masonry block construction. More particularly, the invention relates to a masonry block system that employs a dry stacking interlocking block system with a unique starter device; various elements of the system; and, a method of installation.

BACKGROUND OF INVENTION

Current methods and systems for masonry block construction have several advantages and disadvantages when compared to comparable cast-in-place concrete construction.

Masonry construction does not typically require formwork, both in erection and teardown that is found in concrete construction. Masonry construction also typically reaches design strengths quicker than comparable concrete construction. In general, masonry construction is less costly in material and labor costs than concrete construction.

Conversely, masonry block construction typically requires extensive layout time and labor to properly and accurately start the masonry construction. Further, the time, labor, and material in the installation of block, including mortar, requires continual adjustment and verification that the block wythes are plumb, level, and in alignment. Often too, masonry block construction does not have the ultimate strength of concrete construction.

Accordingly, there is a need for a masonry block system that offers advantages and improvements over current existing concrete and masonry block construction systems and methods.

SUMMARY OF INVENTION

The present invention provides a stacking masonry block system.

A first aspect of the invention provides a masonry block comprising a first surface configured to mate with a bottom surface of a first block, wherein the shape of said bottom surface of said first block corresponds to the shape of said first surface, a second surface configured to mate with a top surface of a second block, wherein the shape of said top surface of said second block corresponds to the shape of said second surface, a third surface having a shape which corresponds to the shapes of said first surface and said second surface, at least one planar surface positioned between said first surface and said third, and wherein said second surface and said third surface are coplanar.

A second aspect of the invention provides a stacking masonry block system comprising a plurality of standard blocks configurable in a stackable row, each of said standard blocks having a top surface and a bottom surface, wherein said bottom surface of each of said standard blocks is configured to mate with said top surface of each of said standard blocks, wherein each of said plurality of standard blocks contain a cavity such that said stackable row has at least one vertical opening therethrough, and a plurality of transition blocks configurable in said stackable row, each transition block having a first surface, a second surface, and a third surface, wherein said second surface of each of said transition blocks is configured to mate with said top surface of each of said standard blocks, said first surface is configured to mate with said bottom surface of each of said standard blocks, and said third surface is configured to intersectingly mate with said top surface of each of said standard blocks.

A third aspect of the invention provides a masonry block system comprising a plurality of blocks, configurable in a stackable row, each of said plurality of blocks having a top surface and a bottom surface, wherein said bottom surface of each of said plurality of blocks is configured to match with the top surface of each of said plurality of blocks, wherein each of said plurality of blocks contains a cavity such that said stackable row has a vertical opening therethrough, a starter rail, configured to mate with said bottom surface of each of said plurality of blocks and configured to be in communication with said vertical opening, said rail including at least a first longitudinal planar surface and a second longitudinal planar surface longitudinally connected to the first longitudinal planar surface, wherein an angle between said first longitudinal planar surface and said second longitudinal planar surface is acute and forms a void when one of the said plurality of blocks is placed over said starter rail, wherein the first longitudinal planar surface is co-planar to the base of the one of the said plurality of blocks when the one of the said plurality of blocks is placed over said starter rail, and wherein the bottom of said void has a larger width than the width of the vertical opening, such that when hardenable, flowable material is poured into said opening and void of said starter rail, movement of the blocks is prevented, an opening located proximate said top surface, said opening extending throughout said plurality of blocks, and wherein at least one of said plurality of blocks has a third surface configured to mate with said top surface to form an intersection.

A fourth aspect of the invention provides a method of stacking interlocking masonry blocks.

The foregoing and other features of the invention will be apparent from the following more particular description of various embodiments of the invention.

BRIEF DESCRIPTION OF DRAWINGS

Some of the embodiments of this invention will be described in detail, with reference to the following figures, wherein like designations denote like members, wherein.

DETAILED DESCRIPTION OF THE INVENTION

Although certain embodiments of the present invention will be shown and described in detail, it should be understood that various changes and modifications may be made without departing from the scope of the appended claims. The scope of the present invention will in no way be limited to the number of constituting components, the materials thereof, the shapes thereof, the relative arrangement thereof, etc., and are disclosed simply as an example of an embodiment. Although the drawings are intended to illustrate the present invention, the drawings are not necessarily drawn to scale.

Figure 1:
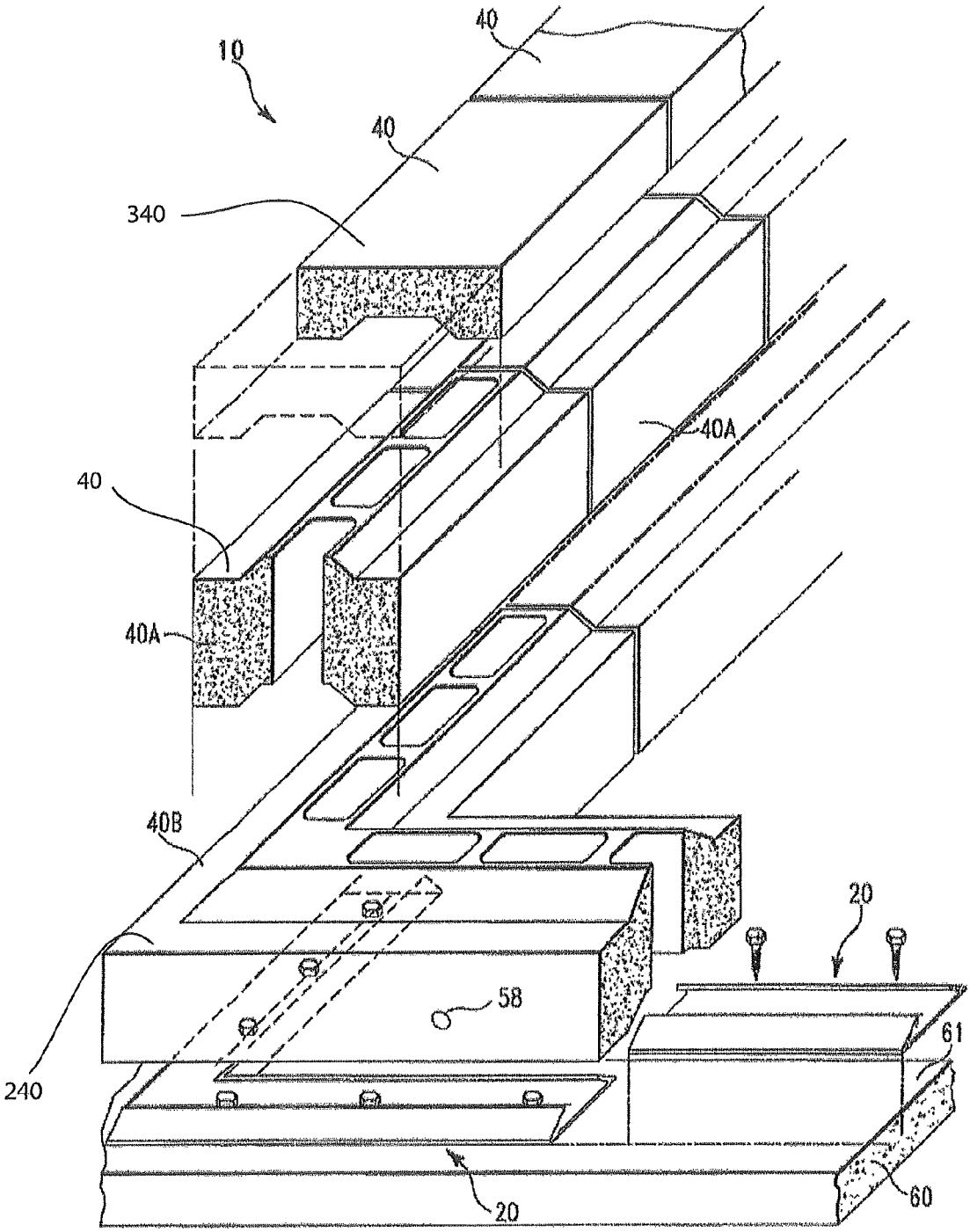
FIG. 1 depicts an exploded perspective view of an embodiment of the interlocking masonry block system, in accordance with the present invention.

Turning to the figures, an exploded perspective view of an embodiment of the invention is depicted in FIG. 1, while FIGS. 2-4 show various details of the invention.

FIG. 1 shows a typical foundation footer 60, often made of concrete, having a top surface 61. Resting and bearing on the footer 60 is a system 10 of the invention. A starter element 20 and a plurality of blocks 40 are placed together on the footer 60. Upon satisfactory installation of the starter elements 20 and the blocks 40, flowable, hardenable material 70 is subsequently placed within the cavities 45 (see e.g., FIG. 11) to bond the entire construct together. In this manner the system 10 is a mortarless, block-type construct having an increased strength.

Figure 2B:
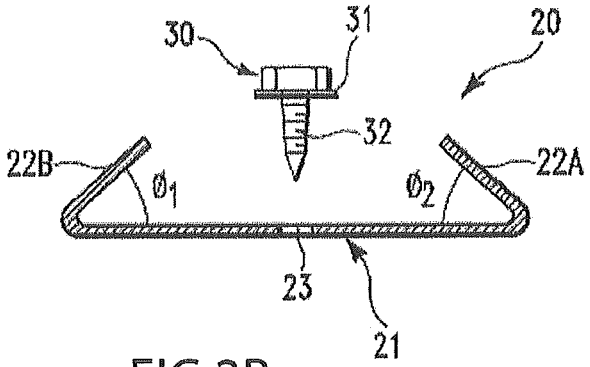
FIG. 2B depicts an end sectional view of an embodiment of a locking starter device, in accordance with the present invention.
Figure 2A:
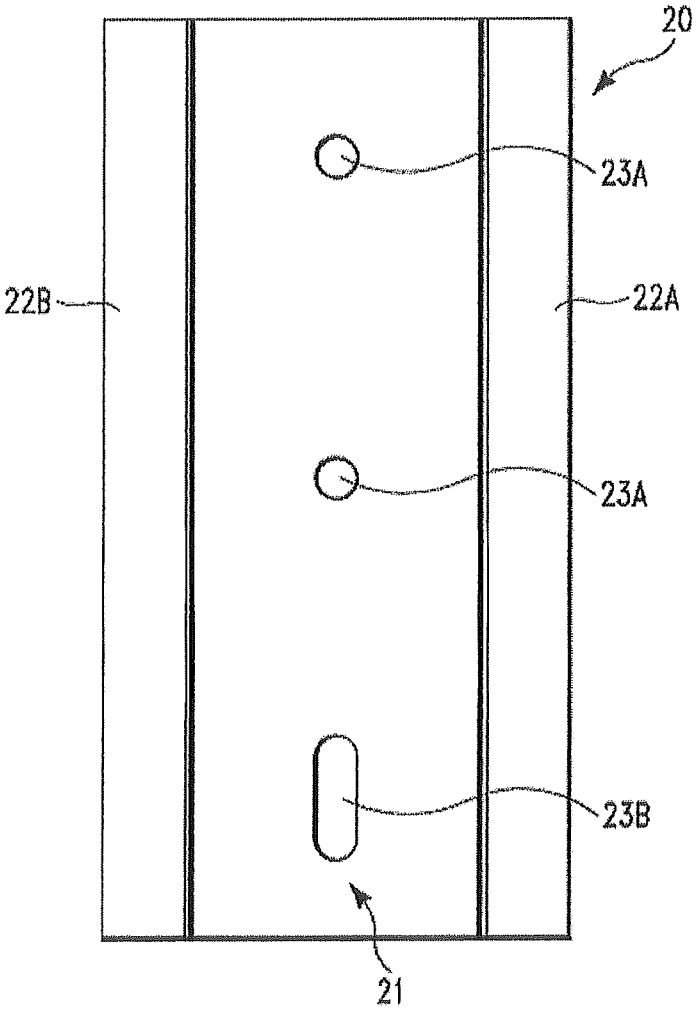
FIG. 2A depicts a top view of an embodiment of a locking starter device, in accordance with the present invention.

As shown in FIGS. 1, 2A, and 2B, the detail and configuration, of an embodiment of a starter strip 20 is shown. The starter strip 20, or element, is typically longitudinal in shape comprised of a plurality of elongate, planar surfaces. The strip 20 includes a first, or base, longitudinal planar section 21, and a second longitudinal planar section 22A. There may be additionally a third longitudinal planar section 22B. Furthermore, the starter strip 20, or starter rail, may be configured to mate with a bottom surface 47 of each of a plurality of blocks 40 and may be configured to be in communication with a vertical opening 45. The starter strip 20, or starter rail may include at least a first longitudinal planar surface 21 and a second longitudinal planar surface 22A longitudinally connected to the first longitudinal planar surface 21, wherein an angle between the first longitudinal planar surface 21 and the second longitudinal planar surface 22A is acute and forms a void when one of the plurality of blocks 40 is placed over the starter strip 20, or starter rail, wherein the first longitudinal planar surface 21 is co-planar to the base of the one of the plurality of blocks 40 when the one of the plurality of blocks 40 is placed over the starter strip 20, or starter rail. The bottom of the void has a larger width than the width of the vertical opening, such that when hardenable, flowable material 70 is poured into opening 45 and void of the starter rail, movement of the blocks may be prevented.

Moreover, the base 21 is configured to lay upon the footer top 61. The base 21 may include a plurality of openings 23 (e.g., 23A, 23B, etc.) shaped to allow various connectors 30 to connect the strip 20 to the footer 60. The openings 23 may be holes, slots, and the like. Similarly, the openings 23 may be spaced and configured to suitably attach the strip 20 to footer 60. For example, FIG. 2B shows one method of attachment, wherein the connectors 30 are a plurality of screws 30 with threads 32 and washers 21 are drilled into the footer 60 in either pre-drilled holes or in a self-tapping manner so as to attach the strip 20 to footer 60. Additionally, the openings 23 are available for allowing reinforcing bar, mechanical or electrical "stub ups", and the like, to pass through the base 21. The strip 20 may be made of a suitable rigid, or semi-rigid, material so that upon its installation the alignment and placement of strip 20 is maintained so as to allow accurately subsequent placement of the blocks 40 upon the strip 20. For example, the strip 20 may be constructed of steel, galvanized material, stainless steel, cold-rolled steel, composite material, and the like. The base or first planar surface 21 is co-planar to the base of at least one of the plurality of blocks 40 when one of the plurality of blocks 40 is placed over the starter rail 20.

Various means and methods may be used to attach the strip 20 to the footer 60. While FIG. 2B shows screws 30 as attachment means, the connectors 30 may be, for example, threaded rod (e.g., J-bolts, straight rod, etc.) embedded within the footer 60 and partially extending above the footer 60. With this means of attachment, the strip 20 is attached to the plurality of threaded rod via nuts. Still alternatively, the strip 20 may be attached to the foundation 60 via a permanent adhesive (e.g., epoxy), and the like. In other embodiments, if the structural application allows, the strip 20 may be lightly pinned down, or laid in place, on the foundation 60, with, for example, aesthetic, light construction, low walls.

The second longitudinal planar section 22A and the third longitudinal planar section 22B are non-parallel with the base 21. Additionally, the second and third planar sections 22A, 22B may be non-parallel to each other. Further, the second and third planar sections 22A, 22B may each form an acute angle, $\phi_1$ and $\phi_2$, respectively, with the base 21. Further, angles $\phi_1$ and $\phi_2$ may, or may not, be equal to each other.

It should be apparent that various configurations of planar sections 21, 22A, 22B are part and parcel of the present invention. For example, any, or all of the sections 21, 22A, 22B may be less than entirely solid. That is the sections 21, 22A, 22B may have various openings. The sections 21, 22A, 22B may be lattice-like in their construction. The openings (not shown) may exist in order to allow the ready flow, or passage of flowable, hardenable material 70 throughout the system 10; to allow for additional elements (not shown) to pass through; to provide a lighter weight strip 20; and the like. Further, while the embodiment in FIGS. 2A and 2B depict sections 21, 22A, 22B that are smooth in construction, clearly appendages, projections, depressions, detents, and the like, can be added while not diverging from the intent of the invention. Additionally, starter strip 20 may also mate, correspond, and/or fit with transition block 140.

Similarly, various configurations of the strip 20 may be employed. The strip 20 can come in various lengths of straight sections. The strip 20 also can be on an angle for constructing corners. The strip 20, thus, may be any angle. The strip 20 can be made on a curve, or multiple curves, of any radius. In these embodiments, the strip 20 can be rigid so that the shape and configuration is fixed. Alternatively, the strip 20 may be semi-rigid. That is, the strip 20 may be constructed so that its shape and configuration may user-adjustable in the field to any angulation and/or curvature. For example, the strip 20 may have gaps or other constructs that allows the installer to move, shape, and bend the strip 20 to the desired configuration. Once installed to the foundation 60, the strip 20 provides a virtually errorless method for installing the subsequent blocks 40.

Figure 3A:
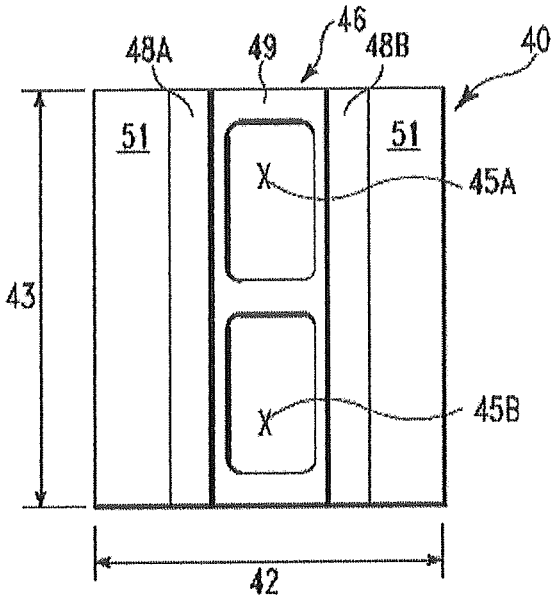
FIG. 3A depicts a top view of an embodiment of a standard masonry block, in accordance with the present invention.
Figure 4A:
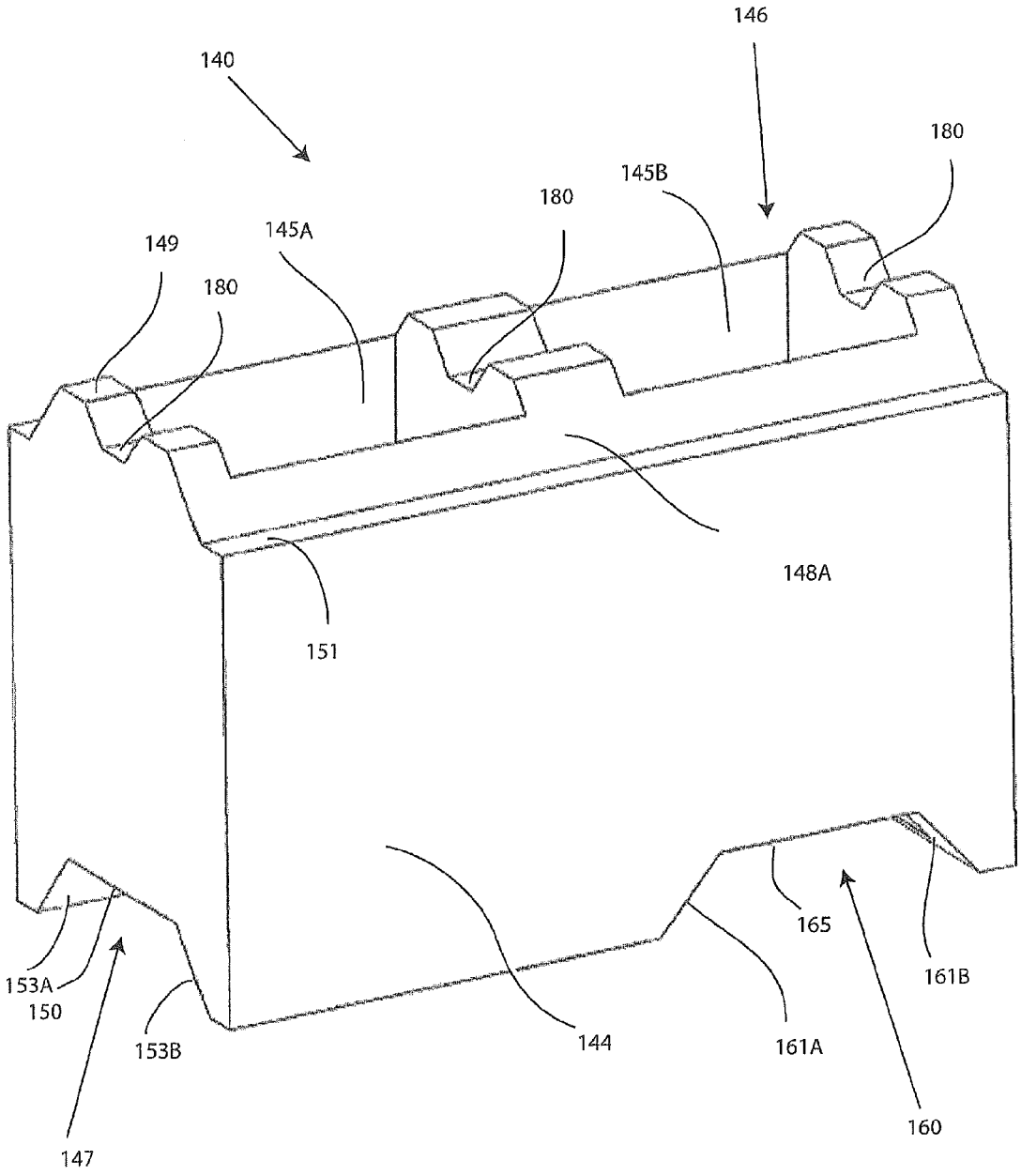
FIG. 4A depicts a perspective view of an embodiment of a transition masonry block, in accordance with the present invention.
Figure 4B:
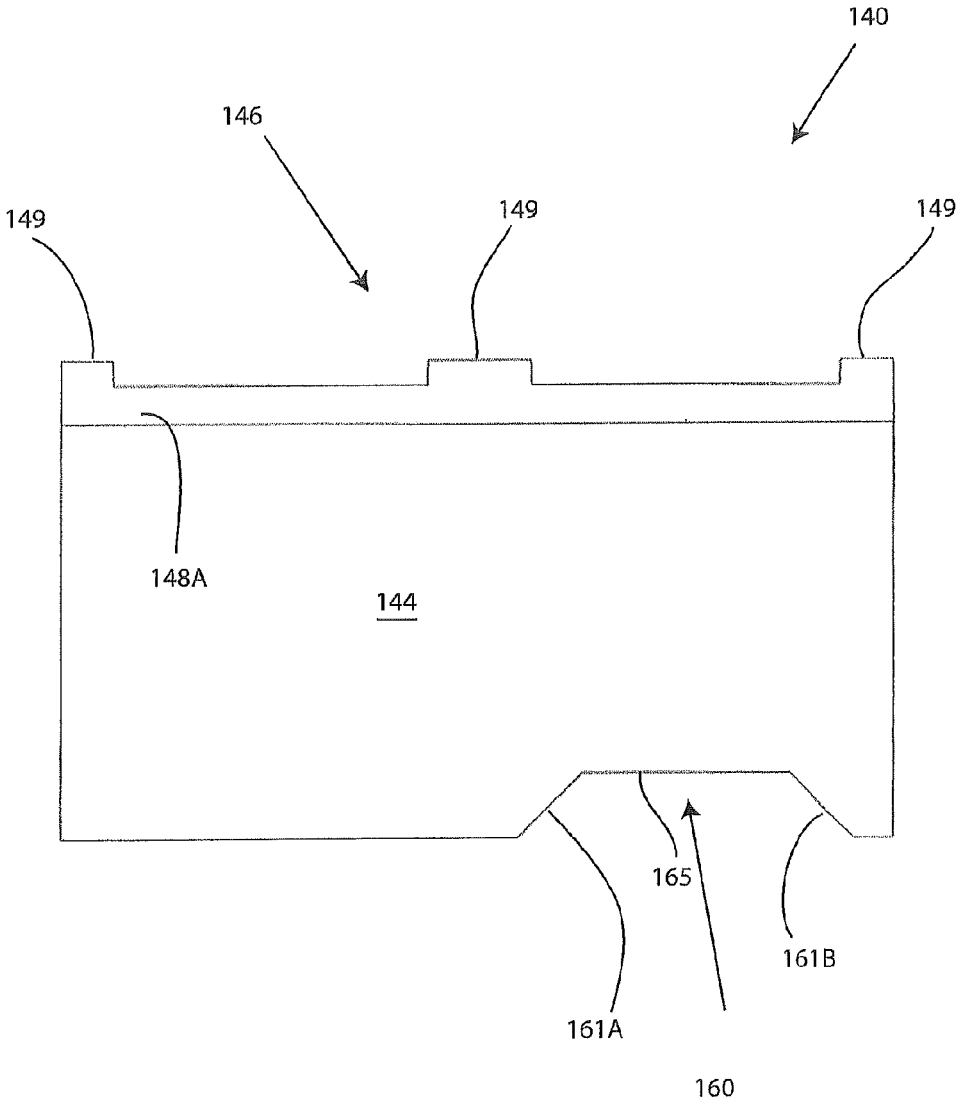
FIG. 4B depicts a side view of an embodiment of a transition masonry block, in accordance with the present invention.
Figure 4C:
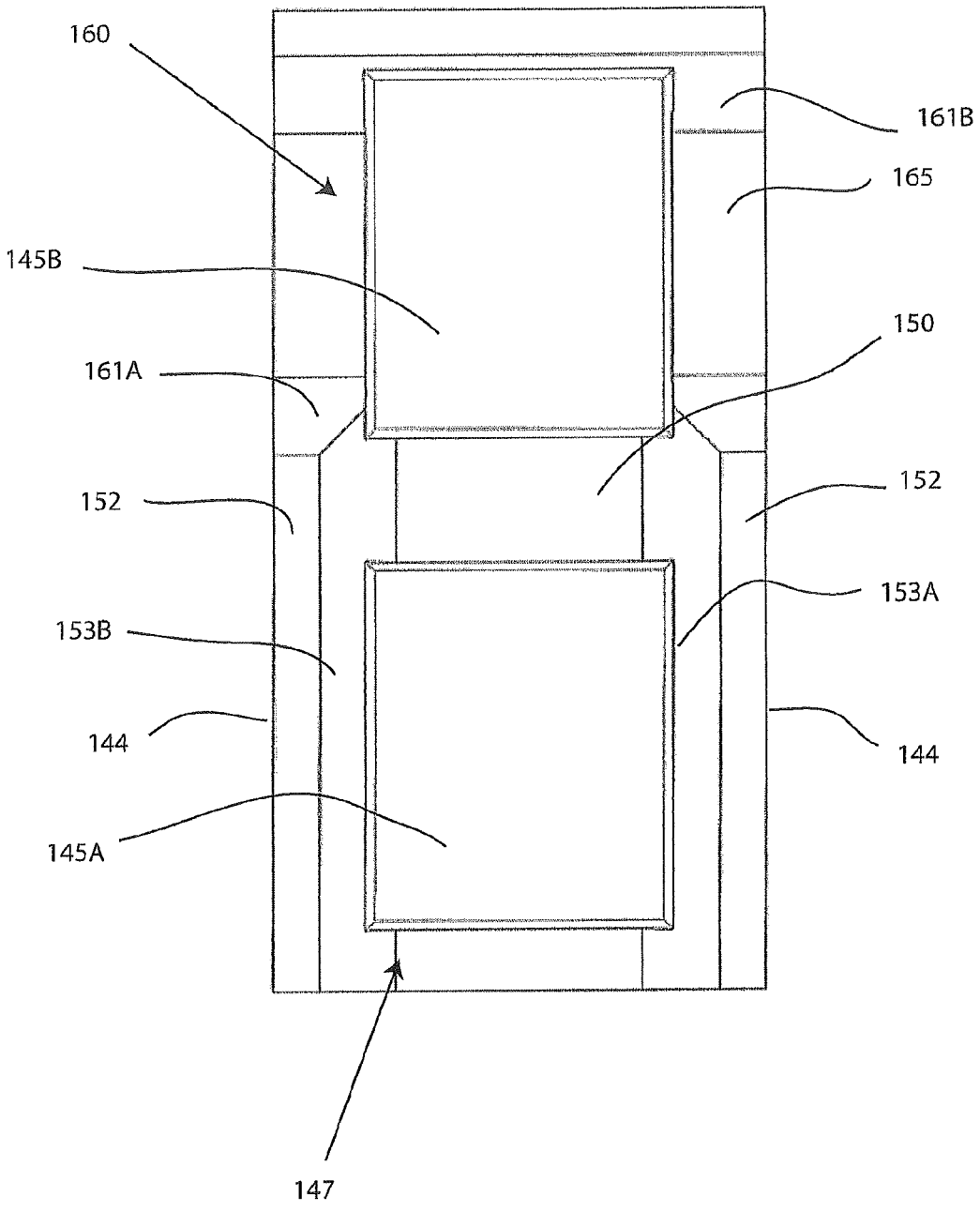
FIG. 4C depicts a bottom view of an embodiment of a transition masonry block, in accordance with the present invention.
Figure 4D:
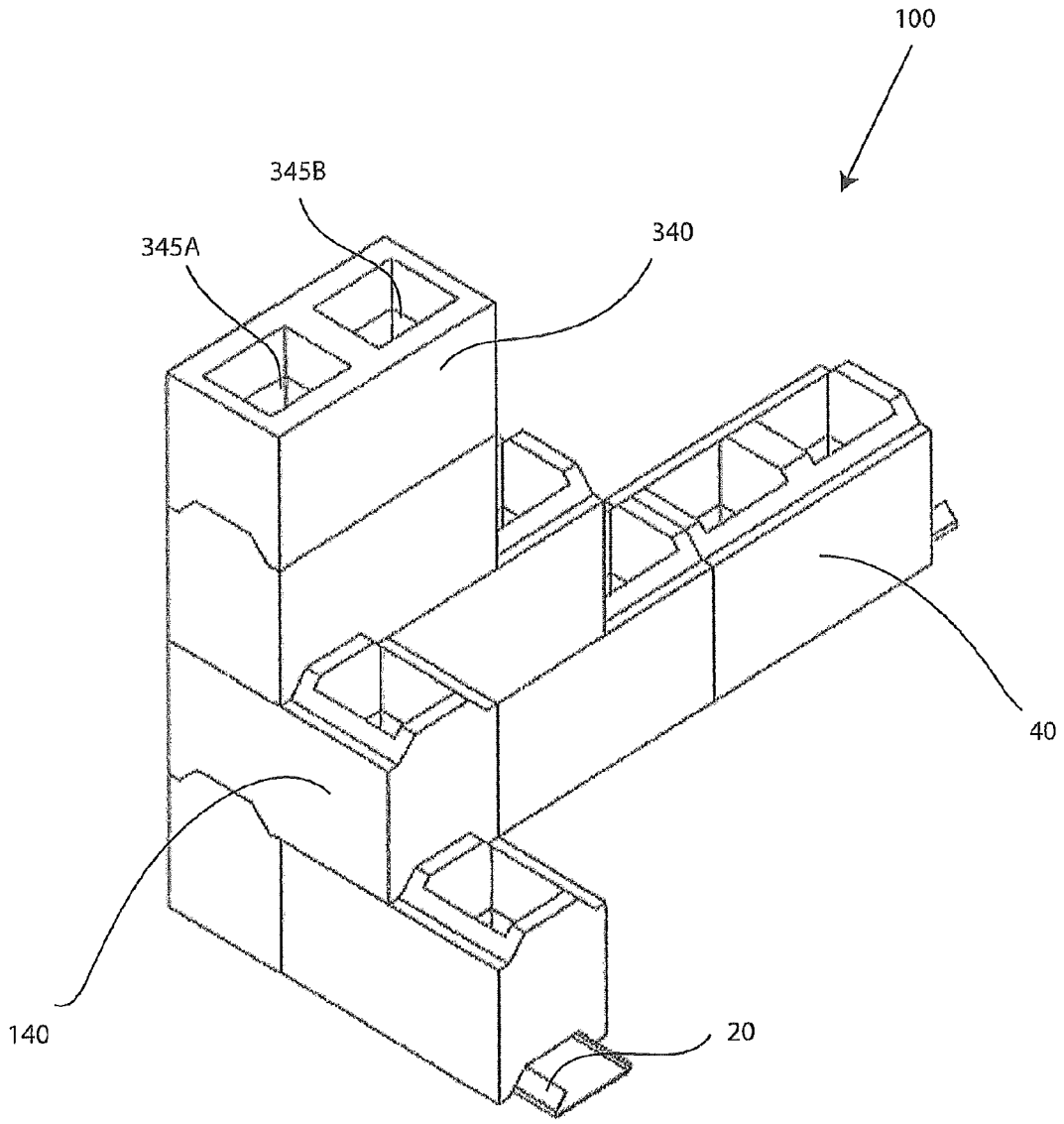
FIG. 4D depicts a perspective view of an embodiment of an assembly of a plurality of masonry blocks, in accordance with the present invention.
Figure 4E:
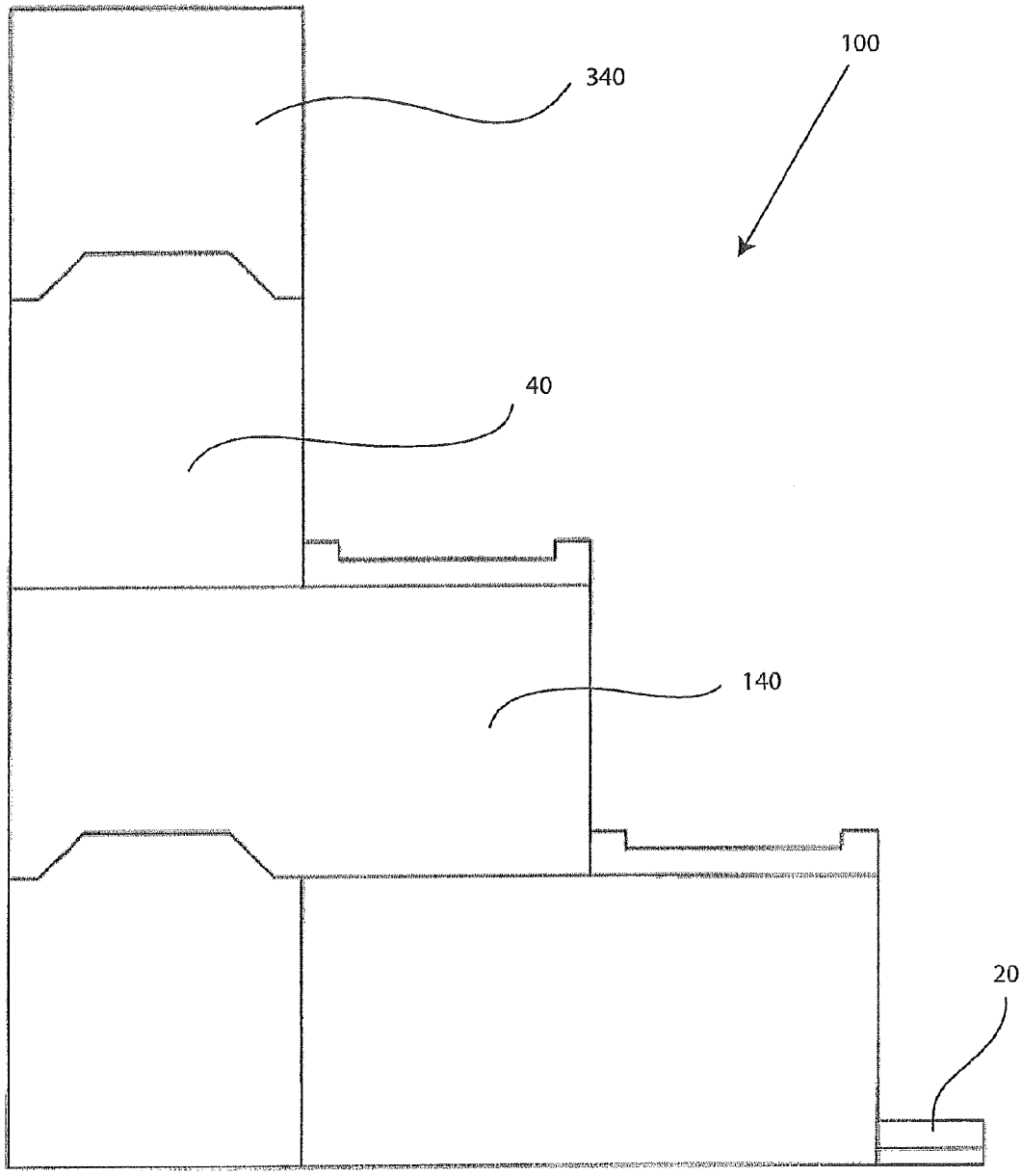
FIG. 4E depicts an end view of an embodiment of an assembly of a plurality of masonry blocks, in accordance with the present invention.
Figure 5A:
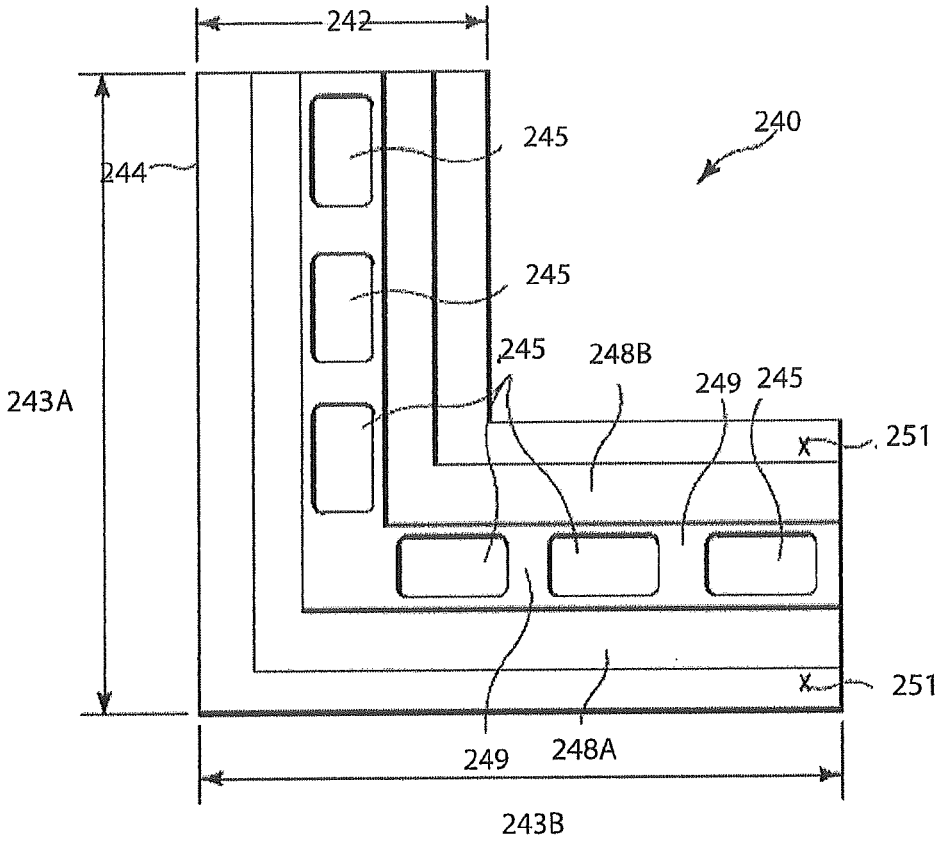
FIG. 5A depicts a top view of an embodiment of a corner masonry block, in accordance with the present invention.
Figure 5B:
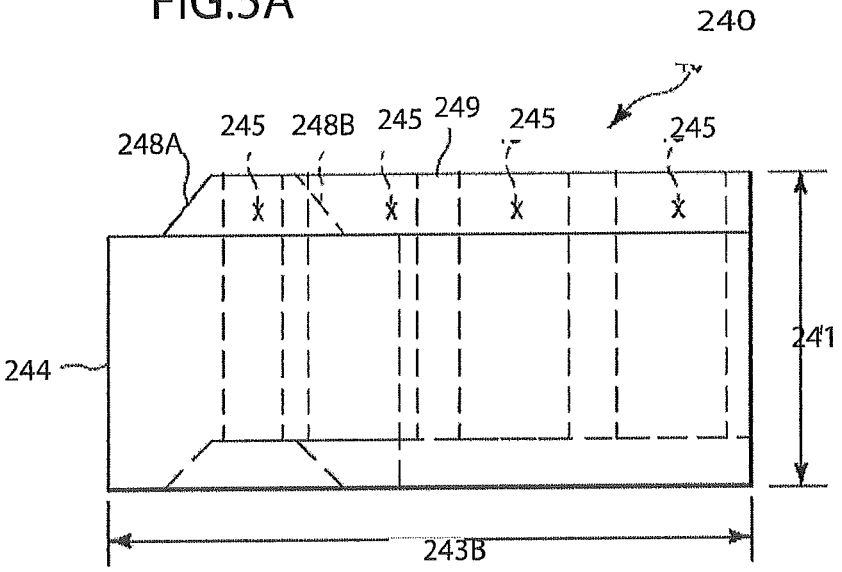
FIG. 5B depicts an end view of an embodiment of a corner masonry block, in accordance with the present invention.
Figure 6A:
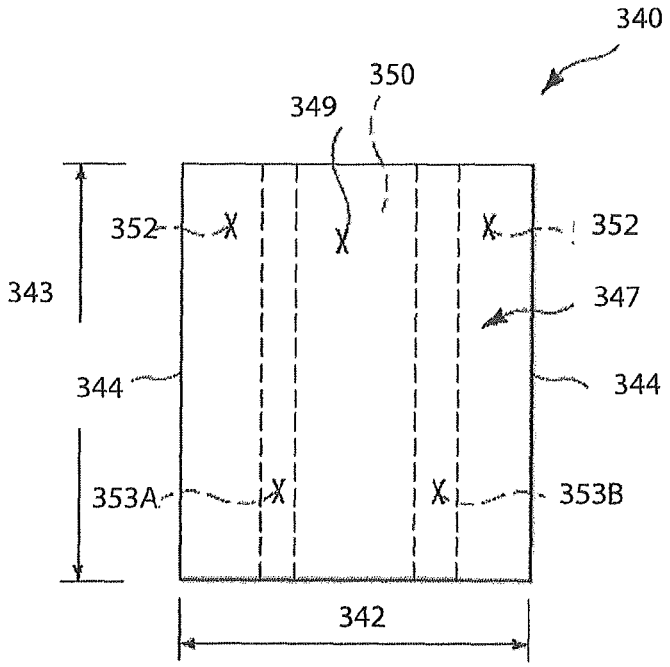
FIG. 6A depicts a top view of an embodiment of a capstone masonry block, in accordance with the present invention.
Figure 6B:
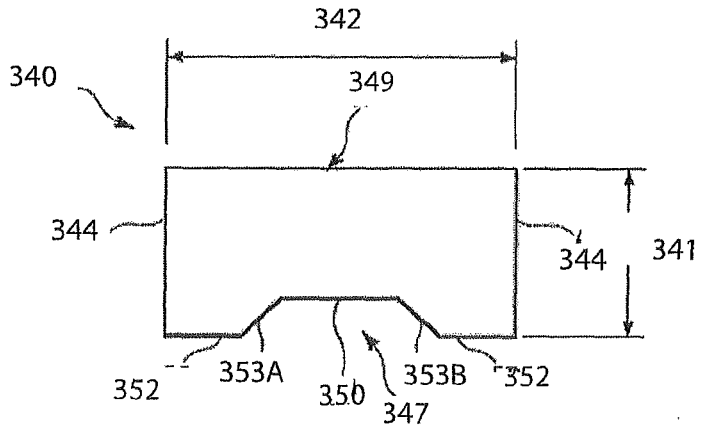
FIG. 6B depicts an end view of an embodiment of a capstone masonry block, in accordance with the present invention.

Turning to FIGS. 3A-6B, several embodiments of blocks 40, 140, 240, and 340 are depicted in detail. FIGS. 3A and 3B depict an embodiment of what could be termed a "typical" or "standard" block 40, FIGS. 4A-4C depict an embodiment of a transition block 140, FIGS. 5A-5B depict an embodiment of a corner block 240, which may also be termed a "L-block," and FIGS. 6A-6B depict an embodiment of a capstone block 340. While each embodiment of block 40, 140, 240, and 340 has its particular use, they may share common aspects of the invention.

Figure 3B:
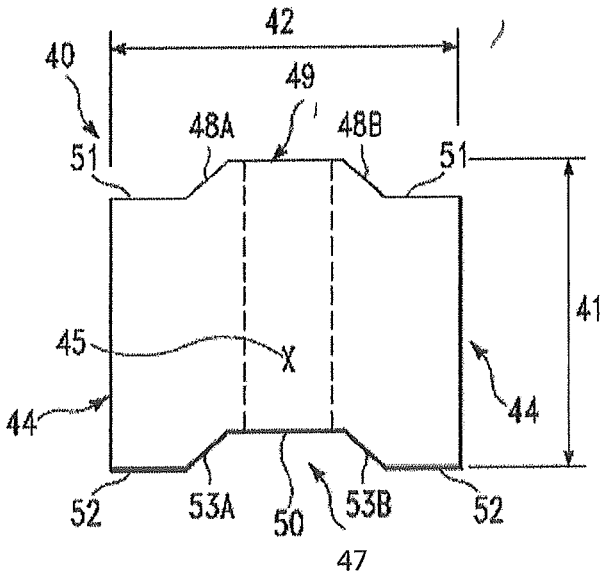
FIG. 3B depicts an end view of an embodiment of a standard masonry block, in accordance with the present invention.

Beginning with FIGS. 3A and 3B, the block 40 has an ultimate height 41, depth 42, and length 43. The block 40 has two substantially vertical faces 44 which are exposed to view after installation. The block 40 includes a first mating area 46 and may also include a second mating area 47. The block 40 includes a top bearing surface 51 and a bottom bearing surface 52. Interstitial to the substantially vertical faces 44 is at least one opening 45.

Both first mating area 46 and second mating area 47 include a horizontal face 49, 50 and typically two canted (i.e., non-horizontal) surfaces 48A, 48B. Thus, the configuration of the blocks 40 is such that the first mating area 46 is shaped so as to mate or fit with the second mating area 47 of an adjacently placed block 40. More specifically, the canted surfaces 48A, 48B and the horizontal faces 49, 50 are such that blocks can readily by placed by the installer easily. Similarly, the first mating area 46 is configured so as to mate or fit with the starter strip 20, as well. Furthermore, mating areas 46, 47 need not have a horizontal surface and two canted surfaces. For example, mating areas 46, 47 may be curvilinear, such as the shape of a half-moon, or may be polygonal in design, encompassing, inter alia, a square, rectangular, trapezoid, and the like. The mating areas 46, 47 may be any form or any shape so long as the shape of the first mating area 146 corresponds to or can mate with the shape of the second mating area 47. Those with skill in the art will also appreciate that the shape of the starter strip 20 may also need to correspond with the shape of mating areas 46, 146, 246, 346. Additionally, it should be understood that all mating areas may also disclose the surfaces of the blocks 40, 140, 340 which are in physical communication with each other.

The configuration of the strip 20 and blocks 40, 140, 240, 340 make installation much quicker and easier than typical block construction. For example, continual checking for alignment, plumbness, etc. is not required, or at the least mitigated significantly. That is once the starter strip 20 is properly aligned and attached (fixedly or removably) to the footer 60, all subsequently aligning activity is abolished, or significantly mitigated.

Clearly, the block 40, may be constructed of any suitable height 41, depth 42, and/or length 43, depending on the particular requirements needed. For example, in the L-shaped embodiment as shown in FIGS. 5A and 5B, the first length 243A may be unequal to the second length 243B.

Similarly, the mating areas 46, 47 need to be on both the top and bottom of the block 40. For example, both a first mating area 46 and second mating area 47 may be present for blocks 40, 140, and 240. Contrastingly, the embodiment depicted in FIGS. 6A and 6B, termed a "capstone" block 340, have only a second mating area 347 on the bottom of the block 40. Other embodiments (not shown) may have only a first mating area 46 on the top of the block 40. That is the bottom of the block 40 may be substantially planar. Such an embodiment may be used as a header, or lintel, over a doorway or window opening in the system 10.

With reference to FIGS. 4A-4E, the transition block 140 has an ultimate height 141, depth 142, and length 143. Clearly, the block 140 may be constructed of any suitable height 141, depth 142, and/or length 143, depending on the particular requirements needed. The block 140 may have two substantially vertical faces 144 which may be exposed to view after installation. The block 140 includes a first mating area 146. Block 140 may also include a second mating area 147. The block 140 includes a top bearing surface 151 and a bottom bearing surface 152. Interstitial to the substantially vertical faces 144 is at least one opening 145.

Furthermore, block 140 may have a transition mating area 160. The transition mating area 160 may be located proximate the back end 73 of the block 140, proximate the bottom of the block 140. Transition mating area 160 may include a horizontal face 165 and two canted mating (i.e., non-horizontal) surfaces 161A, 161B. Thus, the configuration of the block 140 may be such that the transition mating area 160 is shaped so as to mate or fit with a first mating area 146 of an intersectingly placed block 140. For instance, the canted mating areas 161A, 161B and the horizontal faces 165 mate, correspond, interlock, contact, etc., with horizontal face 149 and canted surfaces 148A and 148B of a separate, intersectingly placed block 140 at any location. For example, the transition mating area 160 of a transition block may engage, interlock, contact, mate, etc., with a first mating area 46, 146 at any point, regardless of whether the mating forms a corner or a right angle. In other words, a transition block 140 may intersect a planar surface or wall at any point along the wall, expanding the freedom of design and construction. This corner or intersection configuration may be such that blocks 140 can readily, uniformly, consistently, and easily be placed, stacked, erected, and/or constructed by the installer of system 10 using only blocks 140, block 40, block 240, block 340, or a combination thereof. The plurality of blocks 40, 140, 240, and 340 may form not only a single, planar wall, but a plurality of planar walls connected to each other at intersections or corners. In one non-limiting example, a standard block 40, may be perpendicularly or intersectingly placed underneath block 140 such that shape of the transition mating area 160 mates, fits, or corresponds with the shape of a first mating area 46 of the standard block 40. Moreover, the transition mating area 160 may form a corner or intersection in the construction of system 10. The block 140 may interlock, stack, or mate with other blocks 140 or blocks 40 at both the transition mating area 160 and second mating area 147.

FIGS. 4D and 4E depict an embodiment of an assembly of system 100, wherein a plurality of blocks 40, 140, and 340 are configured in a stackable row to form a wall or structure. Blocks 40 may be placed onto the starter strip 20, as shown in various embodiments. Transition block 140 may allow an installer to quickly, easily, and conveniently create an intersection in the structure. For example, a transition block 140 may be placed onto a standard block 40, such that the transition mating area 160 mates with the first mating area 46 of a standard block 40. The mating of a transition block 140 with a standard block 40, as shown in FIG. 4D, may create an intersection in the structure. In other embodiments, a transition block 140 may be used to form a corner in a structure, wherein the structure is comprised of a plurality of blocks. Those with skill in the art will appreciate that intersections or corners formed by the plurality of blocks 40, 140 may not always form right angles (90°). Transition mating area 160 and the back end 73 of block 140 may be constructed to allow a turn or corner to form an angle from 0° to 180°. For example, the back end 73 of block 140 may be angled, such that the transition mating area is also angled. In addition, the first mating area 146 and block 40 may also be angled to approximately the same angle such that the mating between transition mating area 146 and first mating area 46 may correspond, similar to the description above.

Ostensibly, the configuration of the blocks 140 may also be such that the first mating area 146 is shaped so as to mate or fit with the second mating area 147 of an adjacently placed block 140. More specifically, the canted surfaces 148A, 148B and the horizontal faces 149, 150 are such that blocks 140 can readily be placed by the installer easily. Similarly, the first mating area 146 is configured so as to mate or fit with the starter strip 20, as well. Furthermore, mating areas 146, 147, 160 need not have a horizontal surface and two canted surfaces. For example, mating areas 146, 147, 160 may be curvilinear, such as the shape of a half-moon, or may be polygonal in design, encompassing, inter alia, a square, rectangular, trapezoid, and the like. The mating areas 146, 147 may be any form or any shape so long as the shape of the first mating area 146 corresponds to or can mate with the shape of the second mating area 147, and in the case of the corner or "transition" block 140, also the shape of the corner mating area 160.

Moreover, the first mating area 146 and second mating area 147 may be on both the top and bottom of the block 140. Further, the transition block 140 may only have a transition mating area 160 on the bottom of the block 140.

FIGS. 5A and 5B depict an embodiment of a corner or L-block 240, which may be used to form a corner in the system 10. The corner or edge block 240 has an ultimate height 241, depth 242, and length 243. Clearly, the block 240 may be constructed of any suitable height 241, depth 242, and/or length 243, depending on the particular requirements needed. The block 240 may have two or more substantially vertical faces 244 which may be exposed to view after installation. The block 240 includes a first mating area 146. Block 240 may also include a second mating area 247. The block 240 may also include a top bearing surface 251 and a bottom bearing surface 252. Interstitial to the substantially vertical faces 244 is at least one opening 245. The corner block 240 may be constructed to resemble the capital letter L, forming an edge or corner in the structure of system 10. It may include a first mating area 246 and a second mating area 247. The second mating area 247 may be configured to mate with a first mating area 46, 146, of a standard block 40 and/or transition block 140, respectively.

FIGS. 6A and 6B depict an embodiment of a capstone block 340, which may form the top row of system 100, wherein a plurality of blocks 40, 140, 340 form a structure or wall system. The capstone block 340 has an ultimate height 341, depth 342, and length 343. Clearly, the block 340 may be constructed of any suitable height 341, depth 342, and/or length 343, depending on the particular requirements needed. The block 340 may have two substantially vertical faces 344 which may be exposed to view after installation. The block 340 includes a top bearing surface 351 and a bottom bearing surface 352. Interstitial to the substantially vertical faces 344 is at least one opening 345. The capstone block 340 may not have a first, or top, mating area to mate with a second mating area 47, 147 of a block to potentially be placed immediately on top. The capstone block 340 may only have a capstone mating area 347, configured to mate with a first mating area 46 of a standard block 40, or a first mating area 146 of a transition block 140. Ostensibly, the top of the block 340 may not have a first mating area, resulting in a substantially flat surface, which may form the top row of system 100. The capstone block 340 may be a component in the plurality of blocks forming a structure. Moreover, the top of the capstone block 340, which may be substantially flat, may be solid, or it may have at least one vertical opening therethrough, such as cavity 45 to both allow a flowable, hardenable material 70, such as concrete to flow therethrough, or to allow an installer access to the row of blocks immediately thereunder. The top surface of the capstone block 340 may be exposed after installation of system 10, 100. Furthermore, capstone block 340 may also have a transition mating area 360, as shown in FIG. 4D, such as to allow the top row of system 100, or a single capstone block 340, to intersect at any given point along a planar surface, or along a portion of a structure. For example, a capstone block 340 may have a second mating area 347 to mate with a first mating area 46. 146 of an adjacently placed standard block 40 and/or transition block 140, respectively, while also having a transition mating area 360 to mate with a first mating area 46, 146 of an intersectingly placed standard block 40 and/or transition block 140, respectively.

Other embodiments (not shown) may have only a first mating area 146 on the top of the block 140. That is the bottom of the block 140 may be substantially planar. Such an embodiment may be used as a header, or lintel, over a doorway or window opening in the system 10.

Figure 7A:
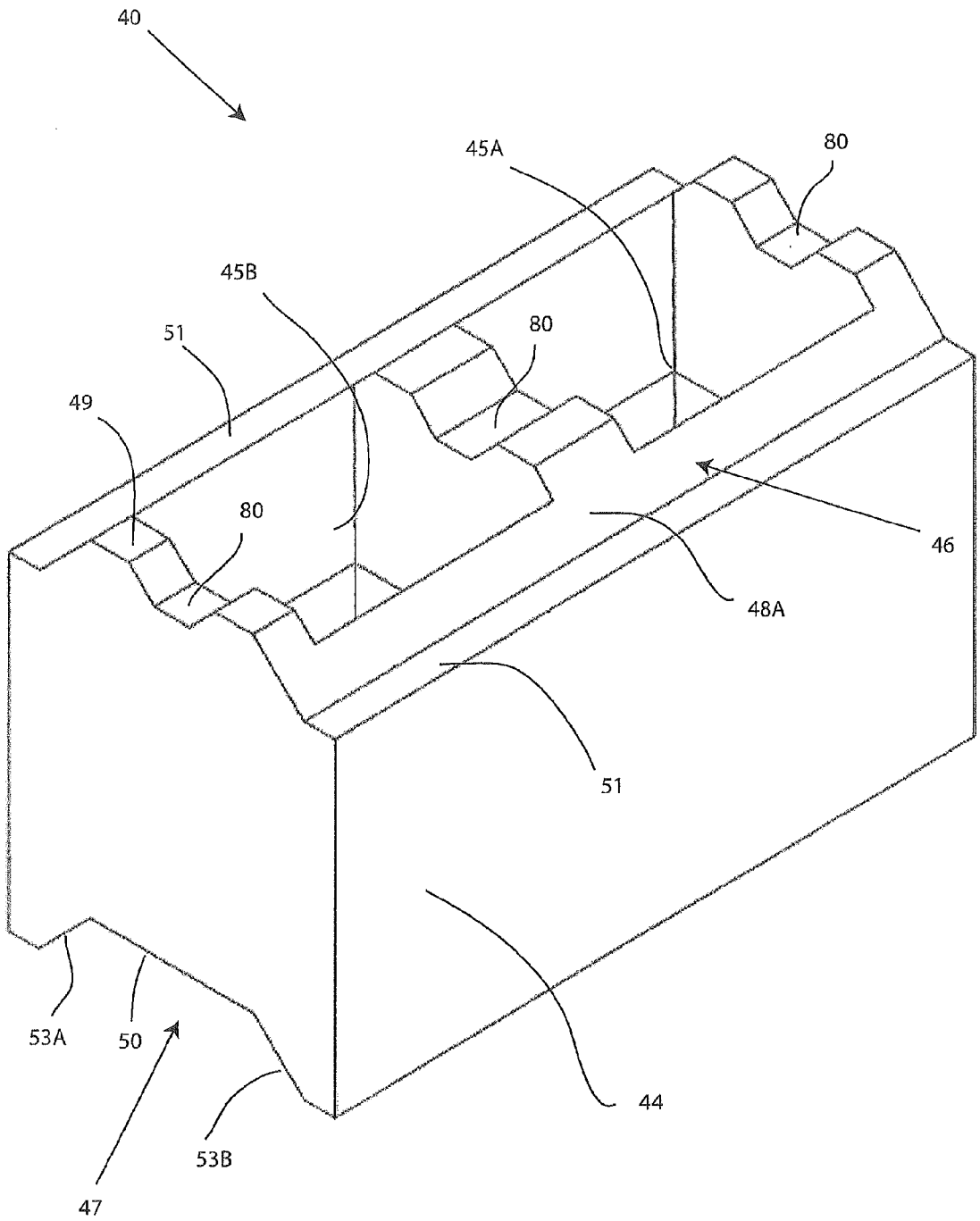
FIG. 7A depicts a perspective view of an embodiment of a standard masonry block having a groove, in accordance with the present invention.
Figure 7B:
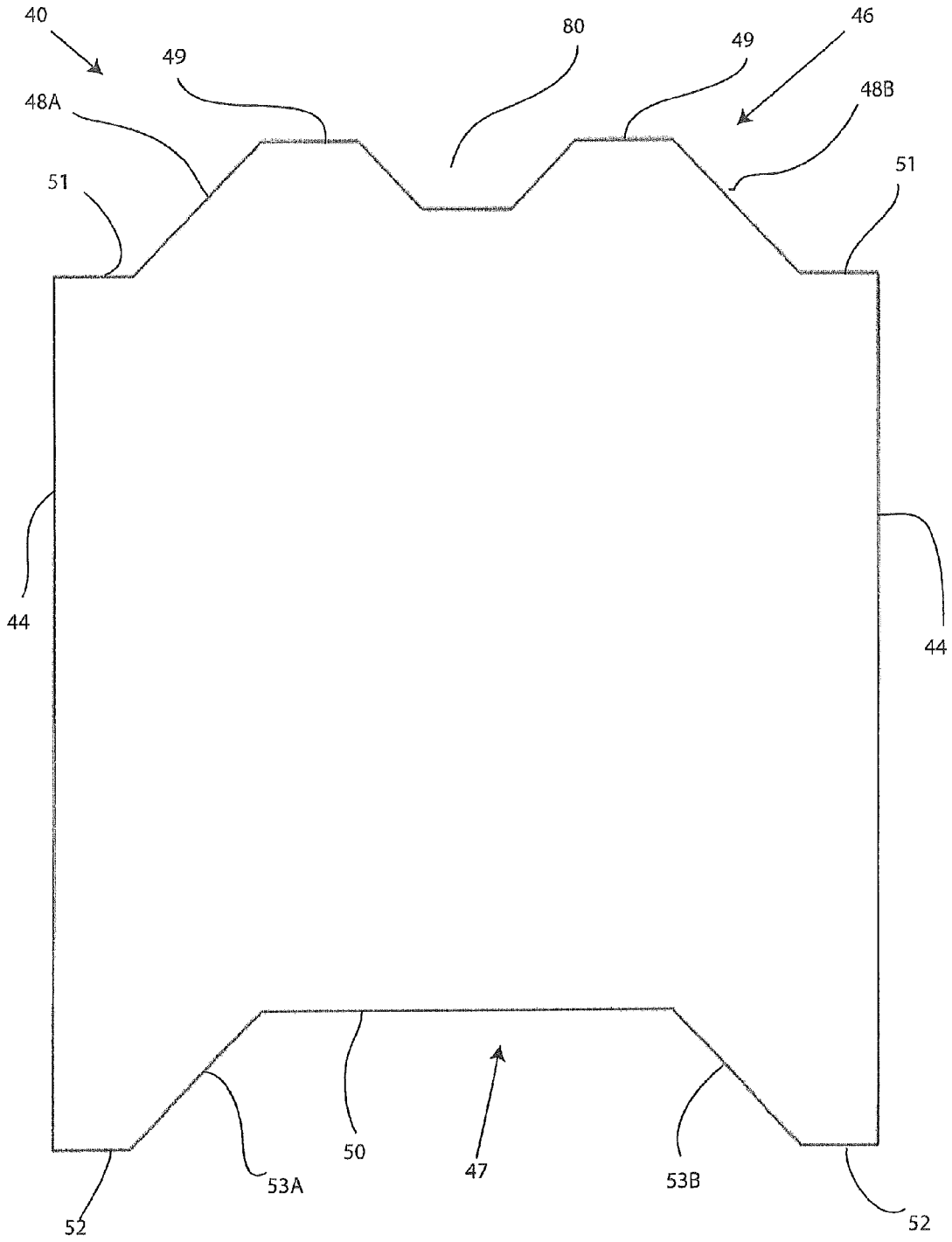
FIG. 7B depicts an end view of an embodiment of a standard masonry block having a groove, in accordance with the present invention.

With continued reference to the drawings, FIGS. 7A-7B depict an embodiment of standard block 40 having a utility groove 80 located within the block 40. Utility groove 80 may be a channel, a trough, a path, a vertical cut-out, an opening, and the like. The utility groove 80 may be any groove, channel, and the like, that may carry, hold, hoist, suspend, accommodate, etc., a variety of materials, such as wiring, through the inside of the block 40. The utility groove 80 may be comprised of three planar surfaces forming more than one holding areas, wherein the utility groove 80 extends the horizontal length of the block 40 and/or extends throughout a single block 40, or a plurality of blocks 40 in system 10. Alternatively, the utility groove 80 may be a rounded, or curvilinear, surface forming more than one holding areas, wherein the utility groove extends the horizontal length of block 40 and/or extends throughout a single block 40, or a plurality of blocks 40 in system 10. In yet another embodiment, the utility groove 80 may be comprised of a combination of planar surfaces and curvilinear surfaces to form a groove extending through a single block 40 or a plurality of blocks 40. Furthermore, the utility groove 80 may be coplanar with horizontal surface 49. The holding areas created by the utility groove 80 may each be coplanar with each other, such that the bottom surface of the utility groove 80 may be coplanar, or level, with respect to each other.

One having skill in the art will appreciate that there may be more than one utility groove 80 per each block 40. Moreover, a utility groove 80 located proximate the first mating area 46 may be aligned with a utility groove 80 of an adjacent block, so as to allow the utility groove 80 to continue along passing through a plurality of blocks 40. An installer may then be able to insert a reinforcing bar, wiring, or any other useful elongate object into a utility groove 80 located on an exposed block 40, and thread or slide the bar or wiring through each of the plurality of blocks 40, without having to disassembly or destroy the existing construction. Those having skill in the art will appreciate that reinforcing bar, wiring, or any elongate element may be placed into the utility groove 80 simultaneous with the construction of system 10, and exposed utility grooves 80 may provide additional access to previously placed rebar or wiring. Thus, the utility groove 80, in particular, the depths of the utility groove 80, may allow a reinforcing bar, set of wires, or other elongate element or elements placed within the utility groove 80 located in the block 40 to remain flush with horizontal face 49. The reinforcing bar, or other elements located within the groove 80 remaining flush with horizontal surface 49 may allow another block 40, 140, 240, or 340 to be stacked on top of block 40 without affecting its ability to engage and properly lock with the bottom block 40. Additionally, the utility groove 80 may be vertically aligned with each other and share axial communication.

The utility groove 80 may also be referred to as a plurality of supports, the plurality of supports located proximate the first mating area 46. Additionally, the groove 80 may be a series or plurality of openings located within block 40, wherein the plurality of openings are coplanar and axially aligned with each other. The utility groove 80 may also be a uniform opening located proximate a first mating area 46 extending throughout the block 40, wherein the uniform opening is separated by at least one vertical opening, or cavity 45.

Figure 8A:
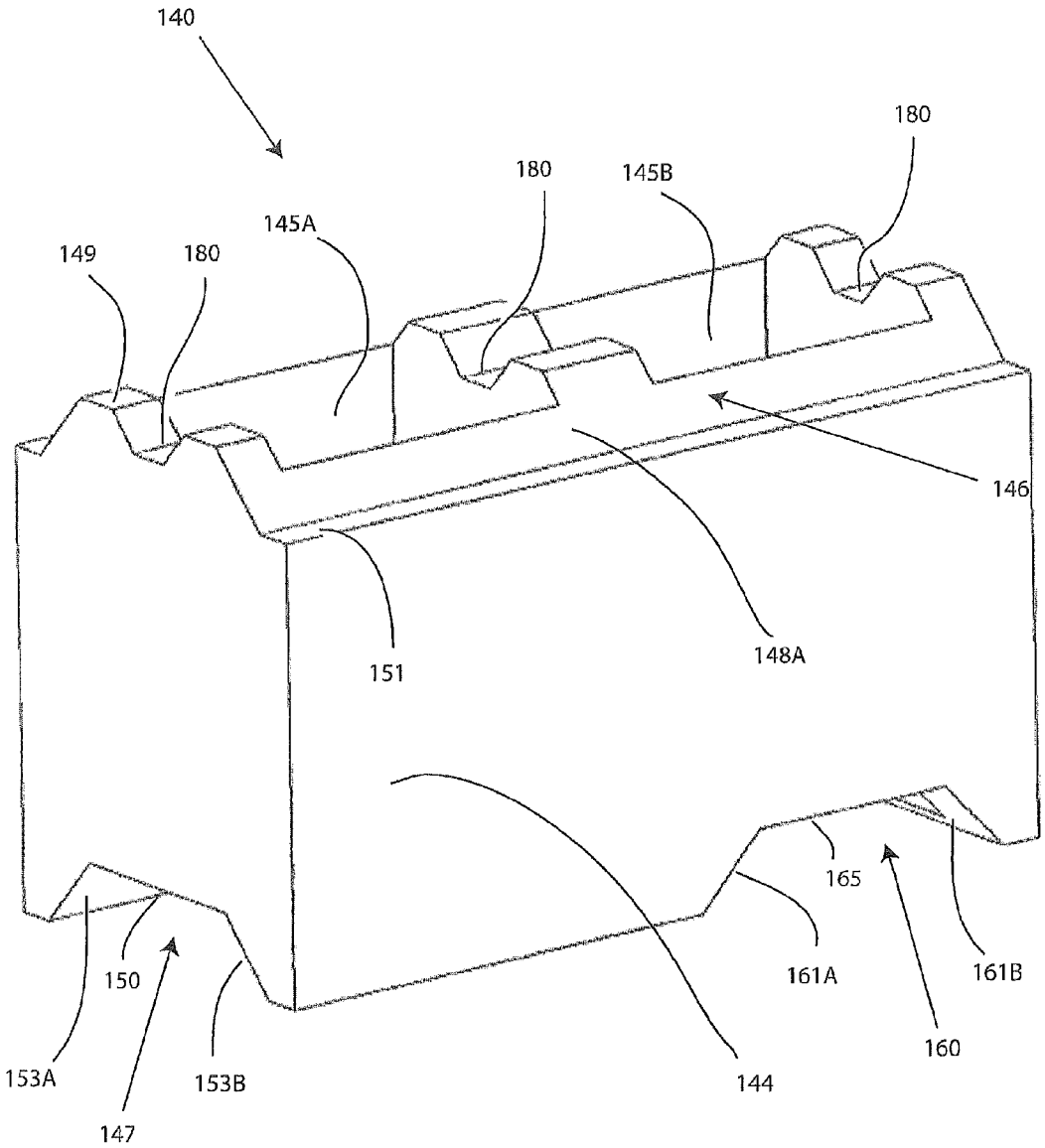
FIG. 8A depicts a perspective view of an embodiment of a transition masonry block having a groove, in accordance with the present invention.
Figure 8B:
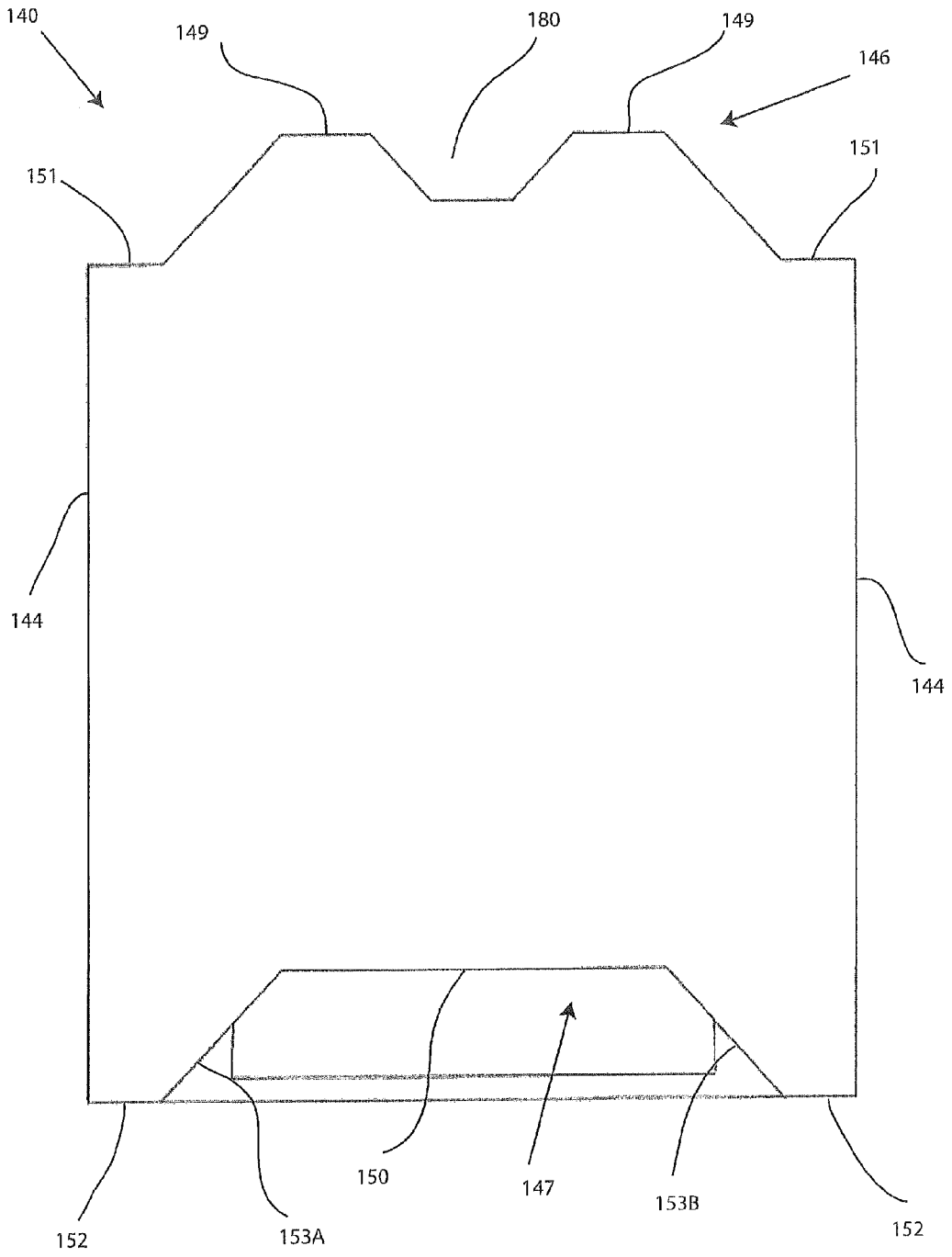
FIG. 8B depicts an end view of an embodiment of a transition masonry block having a groove, in accordance with the present invention.
Figure 8C:
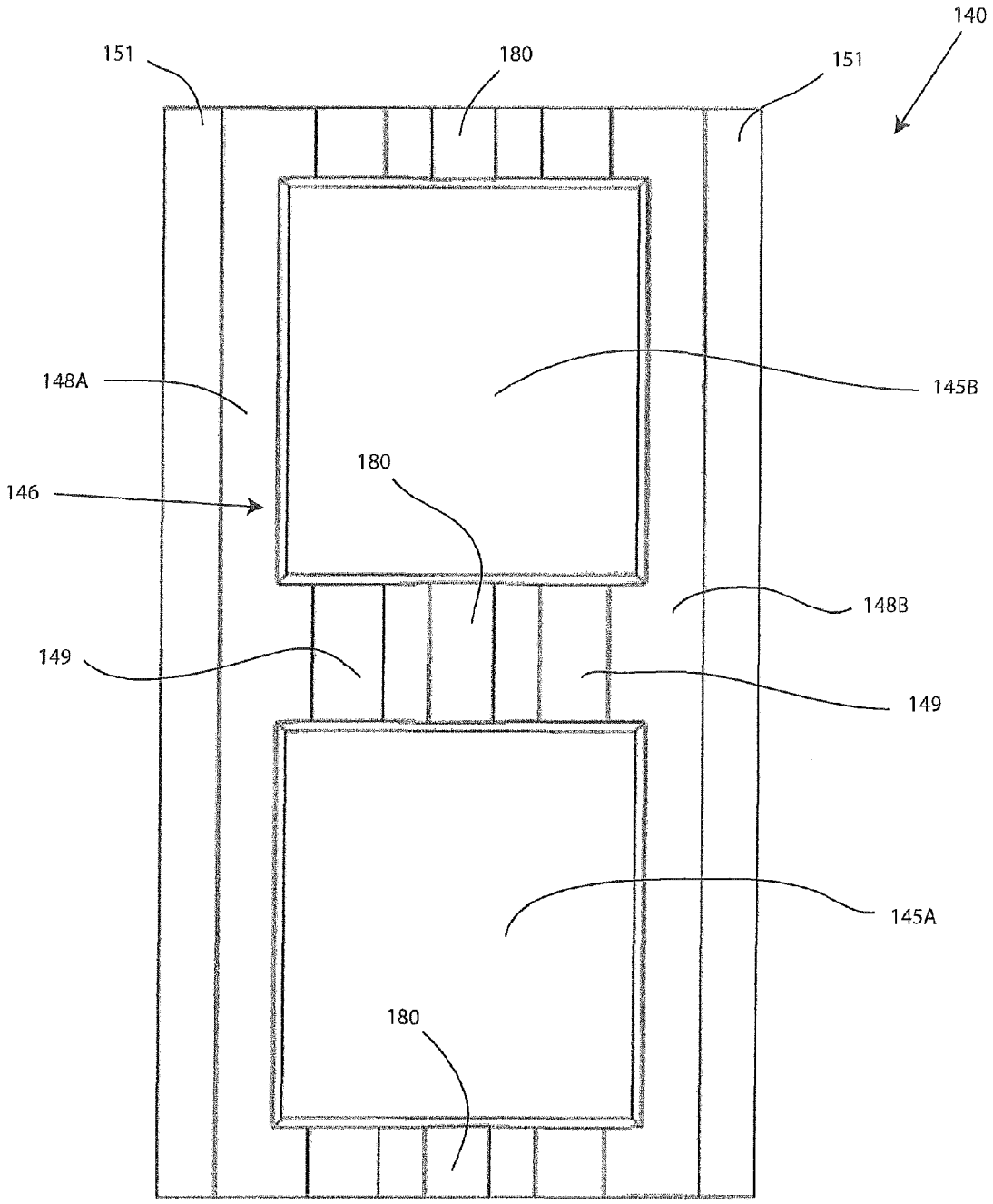
FIG. 8C depicts a top view of an embodiment of a transition masonry block having a groove, in accordance with the present invention.

FIGS. 8A-8C depict an embodiment of a transition block 140 having a utility groove 180 located within the block 140. Utility groove 180 may be a channel, a trough, a path, a vertical cut-out, an opening, and the like. The utility groove 180 may be any groove, channel, and the like, that may carry, hold, hoist, suspend, accommodate, etc., a variety of materials, such as wiring, through the inside of the block 140. The utility groove 180 may be comprised of three planar surfaces forming more than one holding areas, wherein the utility groove 180 extends the horizontal length of the block 140 and/or extends throughout a single block 140, or a plurality of blocks 140 in system 100. Alternatively, the utility groove 180 may be a rounded, or curvilinear, surface forming more than one holding areas, wherein the utility groove extends the horizontal length of block 140 and/or extends throughout a single block 140, or a plurality of blocks 140 in system 100. In yet another embodiment, the utility groove 180 may be comprised of a combination of planar surfaces and curvilinear surfaces to form a groove 180 extending through a single block 140 or a plurality of blocks 140. Furthermore, the utility groove 180 may be coplanar with horizontal surface 149. The holding areas created by the utility groove 180 may each be coplanar with each other, such that the bottom surface of the utility groove 180 may be coplanar, or level, with respect to each other. Each block 40, 140 may have at least one utility groove 80, 180 to facilitate the placement of one or more construction elements, such as reinforcing bars per each block 40, 140. One having skill in the art will appreciate that there may be more than one utility groove 180 per each block 140.

Figure 9A:
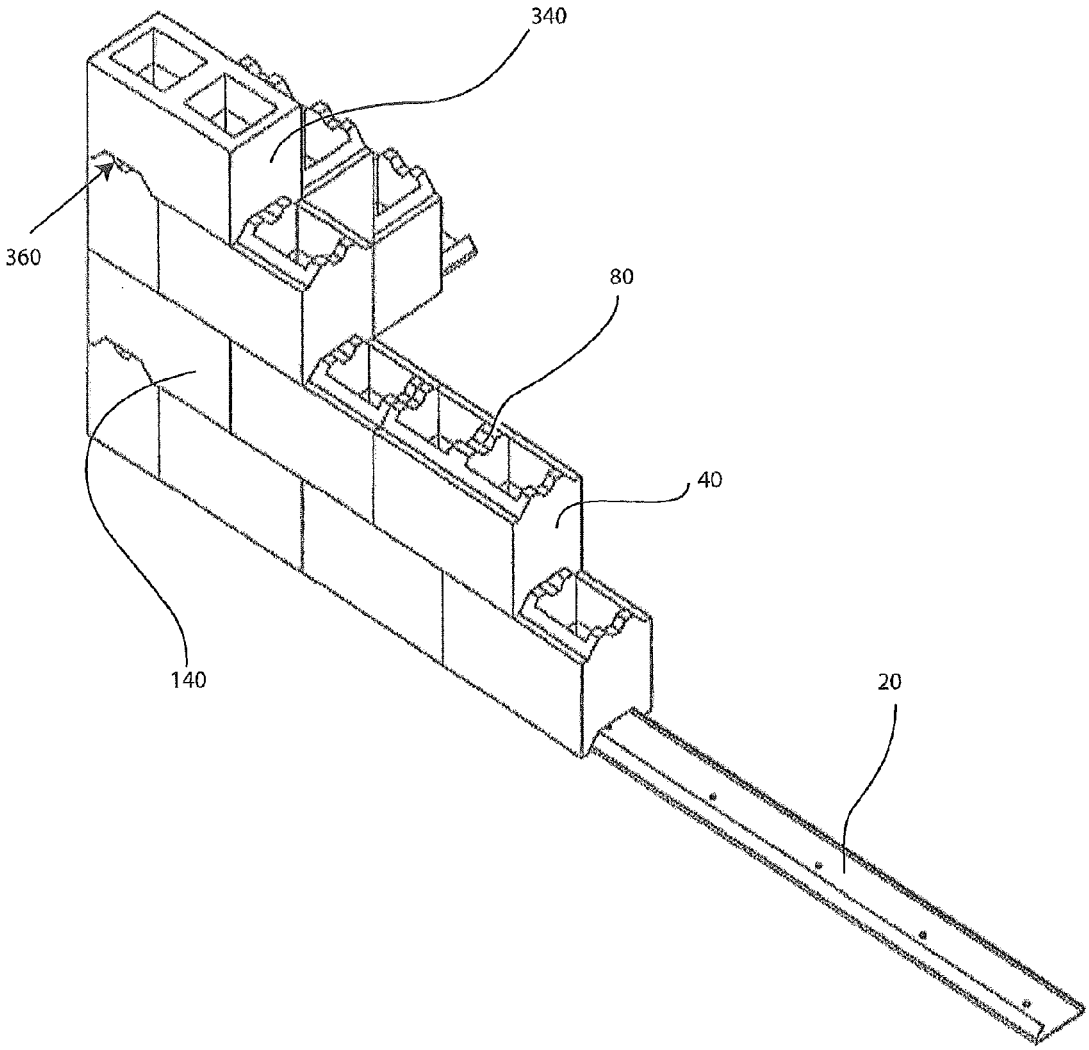
FIG. 9A depicts a perspective view of an embodiment of an assembly of a plurality of masonry blocks having grooves, in accordance with the present invention.
Figure 9B:
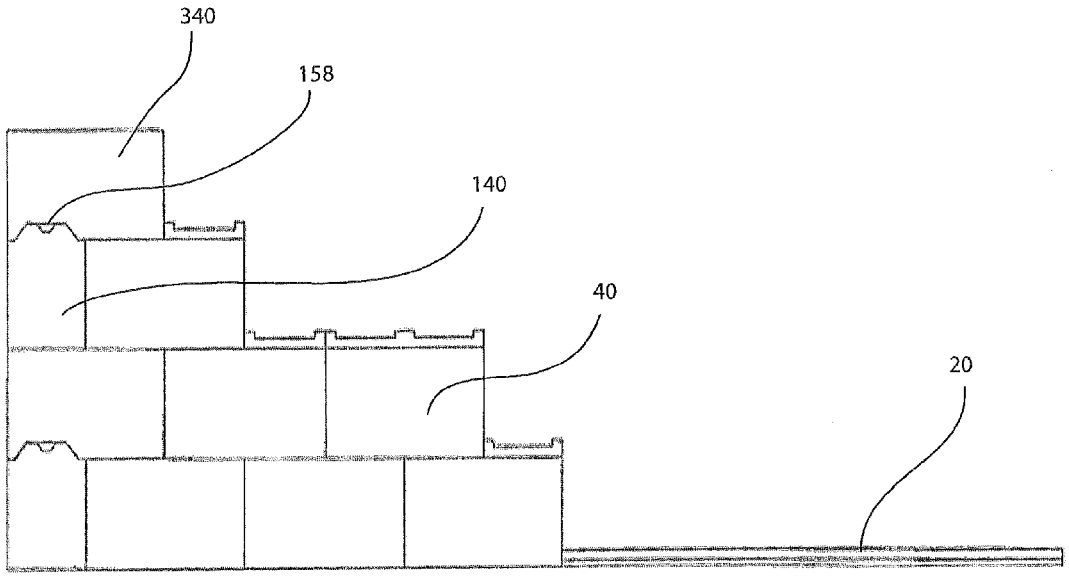
FIG. 9B depicts a side view of an embodiment of an assembly of a plurality of masonry blocks having a groove, in accordance with the present invention.

With reference to FIGS. 9A-9B, a utility groove 180 located proximate the first mating area 146 may be aligned with a utility groove 180 of an adjacent block, so as to allow the utility groove 180 to continue along passing through a plurality of blocks 140. An installer may then be able to insert a reinforcing bar, wiring, or any other useful elongate object into a utility groove 180 located on an exposed block 140, and thread or slide the bar or wiring through each of the plurality of blocks 140, without having to disassemble or destroy the existing construction. Those having skill in the art will appreciate that reinforcing bar, wiring, or any elongate element may be placed into the utility groove 180 simultaneous with the construction of system 100, and exposed utility grooves 180 may provide additional access to previously placed rebar or wiring. In addition, the exposed openings of the utility grooves 80, 180, may allow freshly poured cement into cavity 45, 145, to weep and relieve pressure created from the introduction of the flowable, hardenable material 70. Thus, the utility groove 180, in particular, the depths of the utility groove 180, may allow a reinforcing bar, set of wires, or other elongate element or elements placed within the utility groove 180 located in the block 140 to remain flush with horizontal face 149. The reinforcing bar, or other elements located within the groove 180 remaining flush with horizontal surface 149 may allow another block 40, 140, 240, or 340 to be stacked on top of block 140 without affecting its ability to engage and properly lock with the bottom block 140. Additionally, the utility groove 180 may be vertically aligned with each other and share axial communication. The embodiment of an assembly of system 100 (shown in FIGS. 9A and 9B) depicts the alignment of the standard blocks 40, the transition blocks 140, capstone blocks 340, and their respective utility grooves 180 when forming a structure or plurality of planar surfaces.

The utility groove 180 may also be referred to as a plurality of supports, the plurality of supports located proximate the first mating area 146. Additionally, the groove 180 may be a series or plurality of openings located within block 140, wherein the plurality of openings are coplanar and axially aligned with each other. The utility groove 180 may also be a uniform opening located proximate a first mating area 146 extending throughout the block 140, wherein the uniform opening is separated by at least one vertical opening, or cavity 145.

Figure 10A:
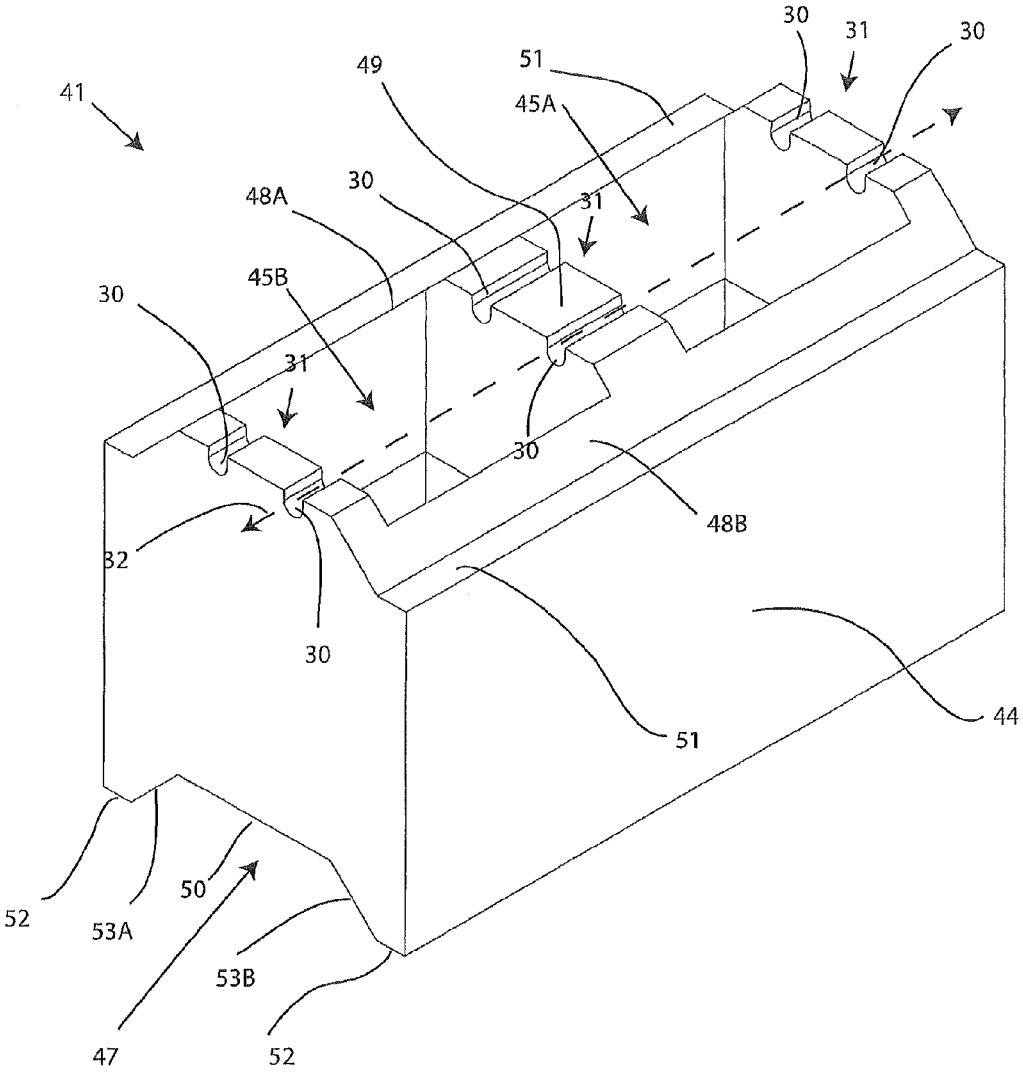
FIG. 10A depicts a perspective view of an embodiment of a masonry block having scallops, in accordance with the present invention.
Figure 10B:
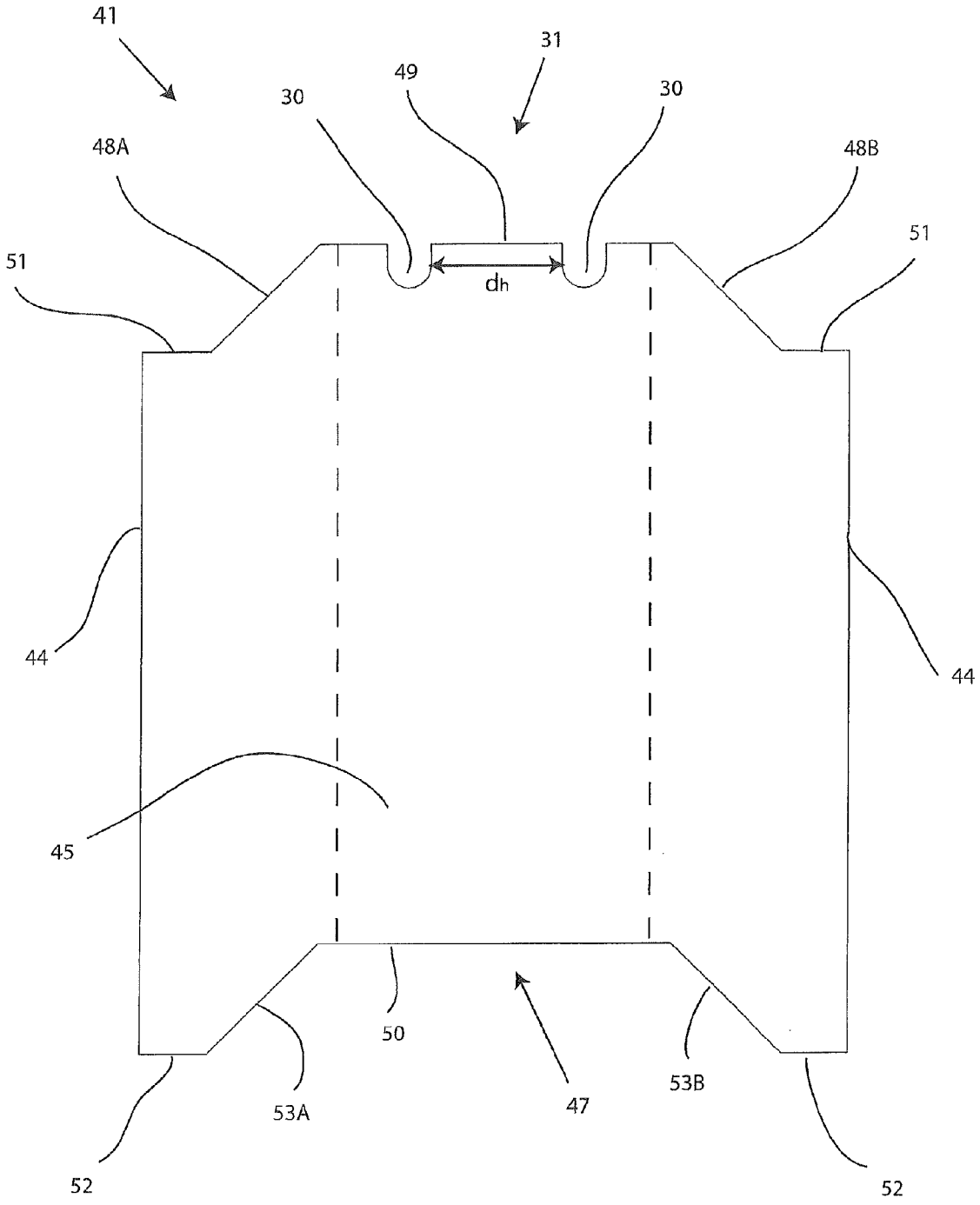
FIG. 10B depicts an end view of an embodiment of a masonry block having scallops, in accordance with the present invention.
Figure 10C:
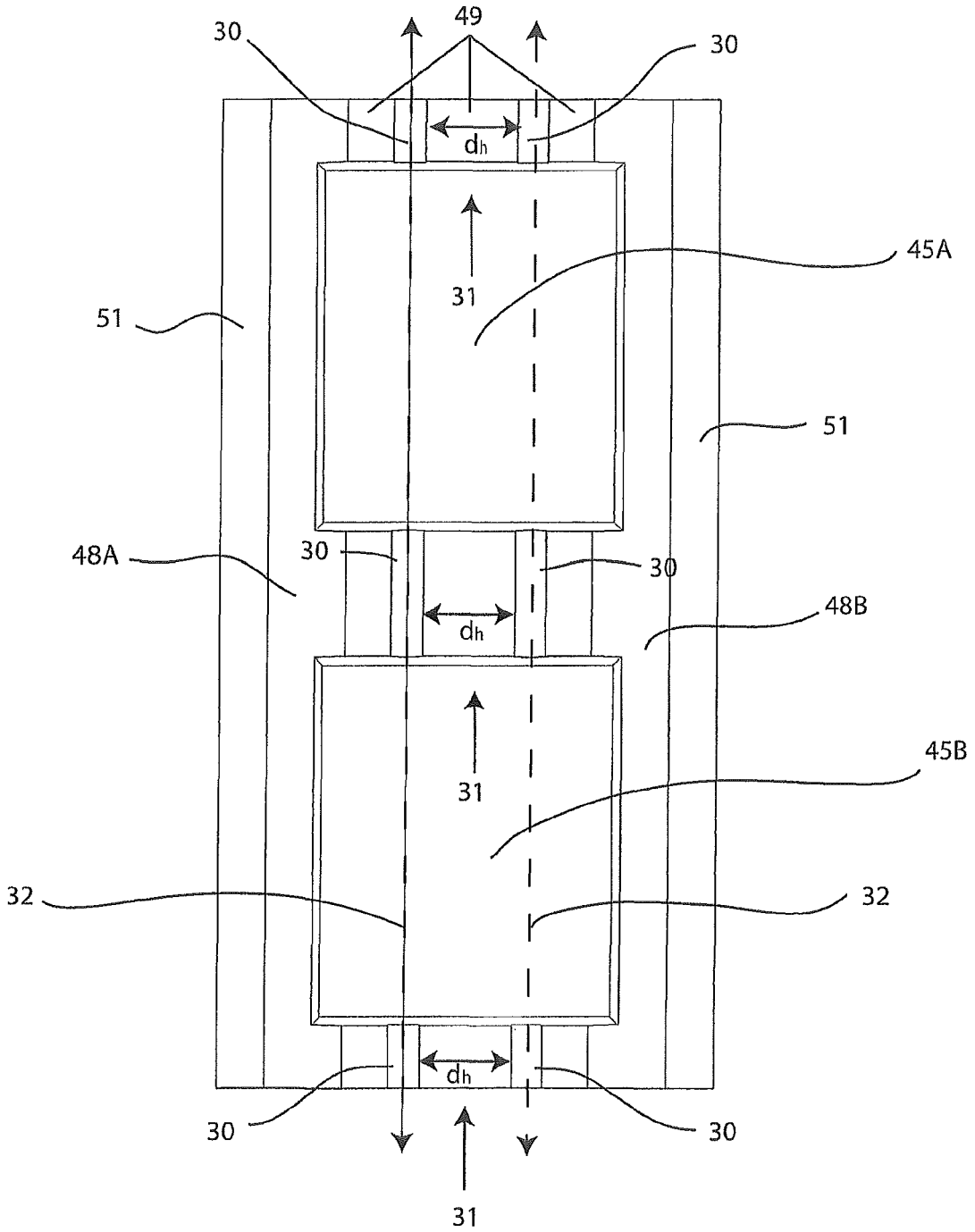
FIG. 10C depicts a top view of an embodiment of a masonry block having scallops, in accordance with the present invention.

Referring now to FIGS. 10A-10C, a reinforcing bar or other suitable reinforcement (not shown) may be located within, threaded or slid through, or extended through a block 40, 140. For instance, the block 40, 140 may have a plurality of scallops 30 to support, house, receive, accommodate, accept, contain, hold, etc., a reinforcing bar extending through the block 40, 140. Scallops 30 may be a channel, cut-out, openings, extrusions, troughs, semi-circular hollow tubes, paths, U-shaped channels, and the like. Moreover, the scallops 30 may have a cross-section, or shape, which corresponds with the cross-section, or shape, of the reinforcing bar to be placed within the scallop 30. Each block 40, 140 may have a plurality of scallops 30 to facilitate the placement of one or more reinforcing bars per each block 40, 140. In one embodiment, a block 40, 140 may be configured to have a series of scallops 30, for example, three scallop sets 32 of two parallel scallops 30 in series succession. It should be understood that the number of scallop sets 32 may vary, and in many embodiments, may have at least one scallop set 32. It should be further understood that systems 10 and 100 may function using blocks 40, 140 without scallops 30 or a utility groove 80, 180. Having scallops 30 cut out or extruded from horizontal face 49 to accommodate a reinforcing bar or other suitable reinforcement may provide a consistent and proper alignment through each block 40, 140, and may also increase the structural strength of the each block 40, 140, in particular, it may increase the tensile strength of the block 40, 140. Thus, the overall structural strength of system 10 and system 100 may be increased, while maintaining the ease and convenience of installment.

Moreover, the scallop sets 32 may be in a parallel or a side by side configuration, and may be spaced apart a horizontal distance, $d_h$, across horizontal face 49, as shown in FIG. 10B. Those with skill in the art will appreciate that distance, $d_h$, may vary according to the structural properties and design codes associated with the particular art. In addition, each scallop set 32 may be spaced apart a distance, $d_h$, to promote uniformity and ease of alignment when installing system 10. However, all of the scallops 30 may be co-planar, for example, the scallops 30 may share the same plane as horizontal face 49. In other words, the bottom surface of each scallop 30 may be level, or on the same plane, with the bottom surface of the other scallops 30 throughout the block 40, 140 such that a reinforcing bar placed along the scallops 30 may also be level. Thus, the scallops 30, in particular, the depths of the scallops 30, may allow a reinforcing bar placed within the scallops 30 located in the block 40, 140 to remain flush with horizontal face 49. The reinforcing bar remaining flush with horizontal surface 49 may allow another block 40, 140 to be stacked on top of block 40, 140 without affecting its ability to engage and properly lock with the bottom block 40, 140. Additionally, the scallops 30 may be vertically aligned with each other. In other words, the scallops 30 may be axially aligned throughout the block 40, 140. Axis 32 depicts the vertical or axial alignment the scallops 30 maintain with respect to each other for ensuring a properly aligned reinforcing bar within the block 40, 140.

Figure 11:
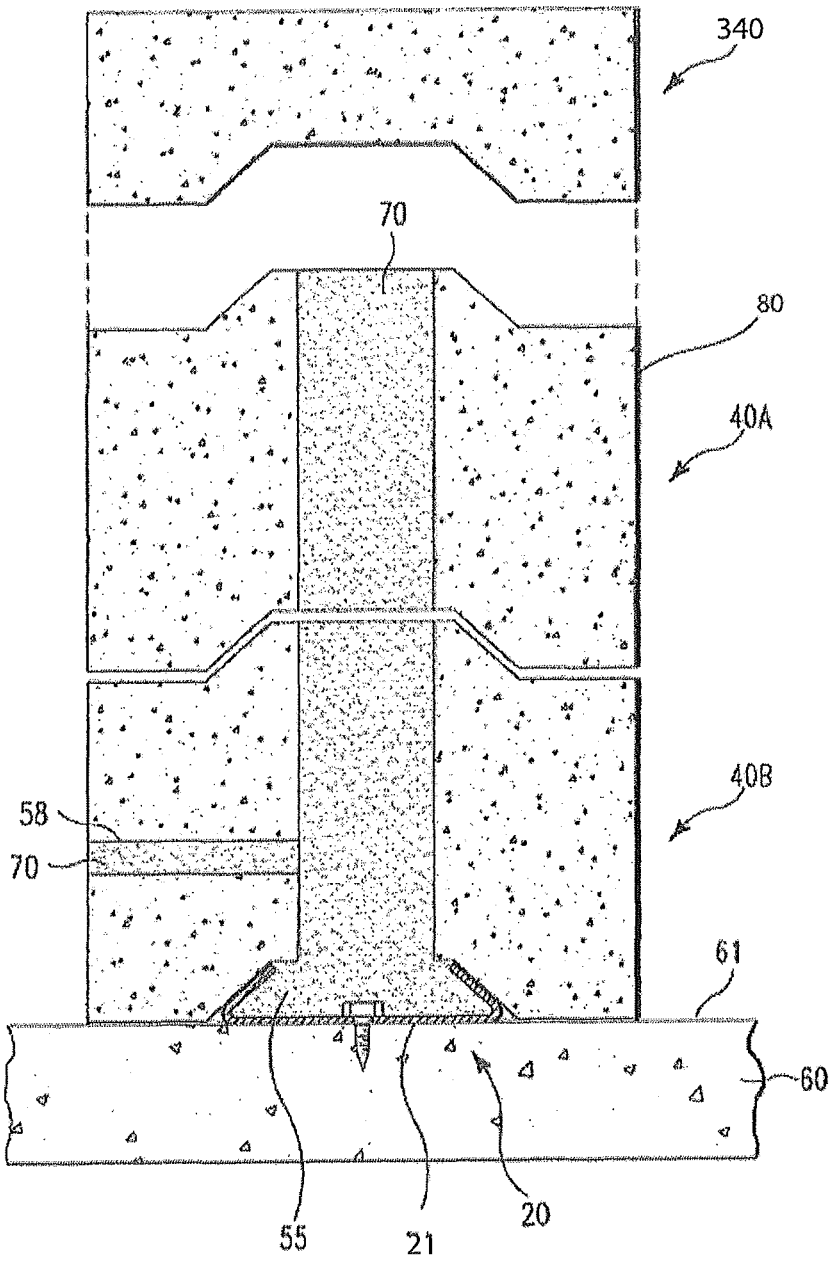
FIG. 11 depicts a close-up sectional view of a portion of the interlocking masonry block system, in accordance with the present invention.

FIG. 11 shows a close up sectional view of a portion of a wall installed under the current invention. A footer top 61 has the strip 20 installed thereon. A first block 40A and second block 40B are shown on top of each other and on the strip 20, in turn. The configuration of the second and third planar sections 22A, 22B as they relate to the configuration of the entire first mating area 46 and the canted surfaces 48A, 48B, are such that upon the installation of the first block 40A a void space 55 is created between the bottom of the face 50 and the strip 20.

Subsequent to the installation of the blocks 40 a flowable, hardenable material 70 is placed, or pumped, into the openings 45. The material 70 may be grout, mortar, concrete, epoxy, and the like. In this manner, a monolithic construct is created between the block 40, material 70 and the footer 60.

The material 70 thus can flow within all the openings 45 in all the blocks 40 as well as into the void 55 around the strip 20. Thus, the material 70, once hardened, converts the block 40 and strip 20 construct into a monolithic structure that is strong in tension, compression, in shear, and the like. The mating areas 46 and 47 add to this aforementioned strength. The strength between adjacent blocks 40A, 40B is greater.

The shape of the starter strip 20 and the void 55 it creates under a first block 40B are such that, once the void 55 is filled with the flowable, hardenable material 70, and once the material 70 hardens, that the material 70 is prevented from moving in the vertical direction with respect to the adjacent blocks 40 in the system 10. That is, the strip 20 and the void 55 together may allow the material 70 to act as a type of key in the system 10. Therein, the system 10 is locked to the foundation 60 below.

As shown in FIG. 11, an optional weep opening 58 may be located on at least one block 40B so as to allow the escaping off of trapped air within the openings 45 during the placement of the material 70. The weep opening(s) 58 may also serve as a viewing port for quality control purposes, to allow, for example, construction inspectors to visually confirm that the flowable material 70 has infiltrated all the openings 45 in the block 40. The weep opening 58 may be singular, or plural, on each block 40 and may be located in any suitable location on the block 40.

Clearly, other variations and embodiments are part and parcel of the invention.

One such variation is that the foundation 60 can be any suitable material for placement and support of the system 10. The foundation 60 is not just limited to concrete footers and the like. Rather, the term as used herein may include suitably compacted gravel, soil, and the like. Similarly, the system 10 can be installed on a foundation 60 constructed specifically for this application. Contrastingly, the system 10 may bear directly on a preexisting concrete slab (e.g., slab on grade, elevated slab, etc.). Thus, the system 10 suits itself for new construction and/or renovation work; exterior and/or interior partitions; building construction and/or landscaping/sitework constructs; and, as a bearing or non-bearing construct. The system 10, for example, can be used to create interior partitions (e.g., partial height, full height, etc.) in an existing building to parcel the existing space into subspaces.

Another aspect of the invention allows for various materials to be placed on the exterior of the walls of the system 10. That is aesthetic; non-structural; and/or, structural materials and/or systems may be placed on the faces of the blocks 40 once installed. For example, the system 10 can be covered with paint, covered with waterproofing, furred out with a wall system, covered with parging, covered with insulation, or other systems.

Alternatively, an exterior structural-type parging system 80 (e.g., ⅛" to ¼" thick) may be added that provides a waterproofing, aesthetic, and/or interlocking strength aspect to the system 10. One type of system that may be added is an Exterior Insulation and Finish System (EIFS), such as the system sold under the name, DRYVIT. Depending on the type of system that is placed on the exterior of the system 10, flowable, hardenable material 70 may not necessarily be required to be placed internal to the block 40. Thus, this exterior system may be used in lieu of, or in addition to, the flowable, hardenable material 70 placed within the blocks 40. Alternatively yet, a hybrid system may be employed wherein the exterior parging system is used, while flowable, hardenable material 70 is only placed in select portions of the system 10. For example, flowable, hardenable material 70 might only be placed where structurally necessary, such as in the corners of the construct and where buttresses, piers, and/or pilasters exist (i.e., locations of greater stress), while the exterior parging system is located on the exterior of the blocks 40 throughout.

While this invention has been described in conjunction with the specific embodiments outlined above, it is evident that many alternatives, modifications and variations will be apparent to those skilled in the art. Accordingly, the embodiments of the invention as set forth above are intended to be illustrative, not limiting. Various changes may be made without departing from the spirit and scope of the invention as defined in the following claims.

I claim:

1. A masonry block system comprising:

a plurality of blocks, configurable in a stackable row, each of said plurality of blocks having a top surface and a bottom surface, wherein said bottom surface of each of said plurality of blocks is configured to match with the top surface of each of said plurality of blocks, wherein each of said plurality of blocks contains a cavity such that said stackable row has a vertical opening therethrough; and a starter rail, configured to mate with said bottom surface of each of said plurality of blocks and configured to be in communication with said vertical opening, said rail including at least a first longitudinal planar surface and a second longitudinal planar surface longitudinally connected to the first longitudinal planar surface, wherein an angle between said first longitudinal planar surface and said second longitudinal planar surface is acute and forms a void when one of the said plurality of blocks is placed over said starter rail, wherein the first longitudinal planar surface is co-planar to a base of the one of the said plurality of blocks when the one of the said plurality of blocks is placed over said starter rail, and wherein the bottom of said void has a larger width than the width of the vertical opening, such that when hardenable, flowable material is poured into said opening and void of said starter rail, movement of the blocks is prevented;

a channel located proximate said top surface, said channel extending throughout said plurality of blocks; and wherein at least one of said plurality of blocks has a third surface configured to mate with said top surface to form an intersection.

2. The system of claim 1, wherein said channel extending throughout each of said plurality of blocks is coextensive between said plurality of blocks.

* * * * *